US006474368B2

(12) United States Patent
Clüsserath et al.

(10) Patent No.: US 6,474,368 B2
(45) Date of Patent: Nov. 5, 2002

(54) BEVERAGE CONTAINER FILLING MACHINE, AND METHOD FOR FILLING CONTAINERS WITH A LIQUID FILLING MATERIAL IN A BEVERAGE CONTAINER FILLING MACHINE

(75) Inventors: Ludwig Clüsserath, Bad Kreuznach (DE); Manfred Härtel, Bretzenheim (DE)

(73) Assignee: KHS Maschinen- und Anlagenbau Aktiengesellschaft, Dortmund (DE)

( * ) Notice: Subject to any disclaimer, the term of this patent is extended or adjusted under 35 U.S.C. 154(b) by 0 days.

(21) Appl. No.: 09/792,129

(22) Filed: Feb. 22, 2001

(65) Prior Publication Data

US 2001/0045242 A1 Nov. 29, 2001

(30) Foreign Application Priority Data

Feb. 23, 2000 (DE) ..... 100 08 426

(51) Int. Cl.[7] ..... B65B 31/00; B67C 3/00

(52) U.S. Cl. ..... 141/6; 141/4; 141/5; 141/94; 141/95; 141/129; 141/144; 141/198

(58) Field of Search ..... 141/4–6, 39, 40, 141/44, 47, 51, 89, 91, 94, 95, 129, 144, 145, 153, 192, 198, 311 R

(56) References Cited

U.S. PATENT DOCUMENTS 4,832,093 A * 5/1989 Morrone ..... 141/198
5,082,033 A * 1/1992 Weiss ..... 141/198
5,240,048 A * 8/1993 Diehl ..... 141/39

* cited by examiner

*Primary Examiner*—Timothy L. Maust
(74) *Attorney, Agent, or Firm*—Nils H. Ljungman & Associates

(57) ABSTRACT

In a beverage container filling machine or plant, an arrangement and a method for filling of bottles, cans, or the like containers, with a liquid filling material, for example, a beverage, using a plurality of filling elements, during the filling process there is monitored, on an individual basis at each filling element, the pressure in the interior space of the container that is connected with this filling element and this actual pressure behavior or value is utilized for monitoring and control purposes.

32 Claims, 8 Drawing Sheets

BEVERAGE CONTAINER FILLING MACHINE, AND METHOD FOR FILLING CONTAINERS WITH A LIQUID FILLING MATERIAL IN A BEVERAGE CONTAINER FILLING MACHINE

BACKGROUND OF THE INVENTION

Field of the Invention

The invention relates to a machine or plant and a method for filling bottles, cans, or the like containers, with a liquid filling material, such as a beverage, with the system comprising a plurality of filling positions, each comprising a filling element at which the corresponding container, at least during a portion of the filling process, is positioned with its filling opening in sealing position and by means of which filling element the interior space of the container is acted upon with at least one process pressure during the filling process in at least one process step. The invention also relates to a method for filling of bottles, cans, or the like containers, with a liquid filling material, such as a beverage, with the use of several filling positions, each comprising a filling element at which the corresponding container is positioned in sealing relation with its container mouth during at least a portion of the filling process and by means of which filling element the interior space of the container is impacted in at least one process step with at least one process pressure during the filling process.

Background Information

For filling of bottles, cans, or the like containers, with a liquid filling material, especially also with beverages, there are known systems or filling machines, in particular also such having a revolving or expressed differently, rotating or circulatory, construction, which comprise a plurality of filling elements at the circumference of a rotor that rotates about a vertical machine axis. The containers that are to be filled are pressed in sealing position with the container opening at these filling elements, at least in the case of a pressure filling, by means of a container carrier. The filling process comprises in known manner a plurality of process or method steps which succeed one another in timed manner; these steps include particularly also those which precede the actual filling, such as, for example, evacuation of and or washing of the interior space of the container, and the like steps.

The quality of the filling process and with this also the durability of the product, that is, of the filling material that has been filled into the container, is decisively a function of the impeccable operation of the filling elements of a filling machine.

OBJECT OF THE INVENTION

It is the object of the invention to provide a machine or system or plant with which is possible, in a simple manner, a monitoring of the filling elements, as well as additionally providing an optimal control of the filling process.

SUMMARY OF THE INVENTION

The invention teaches that this object can be accomplished thereby that in a beverage container filling machine, system or method for filling of bottles, cans, or the like containers, with a liquid filling material, for example, a beverage, using a plurality of filling elements, during the filling process there is monitored, on an individual basis at each filling element, the pressure in the interior space of the container that is connected with this filling element and this actual pressure behavior or value is utilized for monitoring and control purposes.

The invention further teaches that this object can be accomplished by a filling machine for filling beverage containers, such as bottles, cans, or the like, with a liquid in a container filling process, said filling machine comprising: a plurality of filling positions; each filling position having a filling element to fill a corresponding container with liquid; apparatus to move empty containers to a filling element; each filling element being configured and disposed to receive a corresponding container to be filled from said apparatus to move empty containers; apparatus to remove a filled container from a filling element; apparatus to hold a container to be filled in sealing attitude at a filling element; each filling element having a portion to introduce at least one process pressure into the interior space of a corresponding container; at least one pressure sensor for each filling element; each sensor being disposed and configured to sense a pressure related to the interior of a corresponding container that is connected with the corresponding filling element; each sensor being configured to produce at least one indication representative of a sensed pressure related to the interior of a corresponding container; a controller; said controller being configured to receive from a corresponding sensor said at least one indication representative of a sensed pressure related to the interior of a corresponding container; and apparatus configured to control at least one process parameter related to filling a container in the filling machine; said controller being further configured to control said control apparatus for said at least one process parameter of said filling machine.

The invention also teaches that the foregoing object can be accomplished by a beverage filling machine for filling containers, such as bottles, cans, or the like, with a liquid in a container filling process, said filling machine comprising: apparatus to fill said containers with liquid; apparatus to move empty containers to said filling apparatus; apparatus to remove filled containers from said filling apparatus; each filling apparatus comprising at least one pressure sensor; said at least one pressure sensor being configured and disposed to sense at least one pressure condition related to the interior space of a corresponding container that is connected with said filling apparatus and said sensor being configured to pass at least one indication representative of an at least one sensed pressure condition; a controller; said controller being configured to receive said at least one indication representative of an at least one sensed pressure condition; and apparatus to control at least one process parameter related to filling a container in the filling machine; said apparatus to control at least one process parameter being configured to receive process control functions under instructions from said controller based on said at least one indication representative of an at least one sensed pressure condition related to the interior space of a corresponding container.

The invention further teaches that the object can be accomplished by a method of filling containers, such as bottles, cans, or the like containers, with a liquid filling material, in a beverage container filling machine including a plurality of filling positions, each filling position comprising a filling element, said method comprising the steps of: (a) positioning a container for filling with its mouth in sealing attitude at said filling element; (b) introducing at least one process pressure into said container at each filling element; (c) sensing at least one pressure indication representative of an at least one process pressure condition related to the interior space of a corresponding container with a sensor at each filling element; (d) passing said at least one pressure indication representative of an at least one process pressure condition related to the interior space of a corresponding container to a controller; and (e) controlling said at least one process pressure condition at least under adjustment of time with said controller.

Thus, the invention provides a machine or system in which at each filling element there is provided at least one pressure sensor which collects, during the filling process, the pressure in the interior space of the container that is connected with the filling element and the sensor delivers an electrical signal in conformity with this pressure to an electronic unit, or expressed differently, a controller, which is common to all filling elements.

The invention further teaches that this object can be accomplished by a method wherein at each filling element during the filling process the pressure in the interior space of the container that is connected with the filling element is individually collected and that electrical signals in conformity with the pressures are passed to a controller which is common to all filling elements.

In the invention there is collected data corresponding to the effective or, expressed differently, current or actual, pressure behavior (actual pressure behavior-actual value) on an individual basis at each filling element and it is individually assessed by an electronic unit or, expressed differently, by a central controller.

The invention is based on the recognition that solely on the basis of the measured pressure behavior there can be monitored the proper functioning of each filling element of a filling machine and, as applicable, an error can be recognized at an early stage, that is, already prior to the error affecting the quality of the product. Such a diagnosis is established by the constant comparison of the actual pressure behavior (actual value) with a set point value pressure behavior (set point value).

The system in accordance with the invention additionally allows to correct errors in individual method steps in such a way that the actual or, expressed differently effective, value corresponds very closely to the set point value of the corresponding method step. This correction, preferably, and in a particularly simple manner, is achieved by a corresponding change of the duration of the corresponding method step. A control or adjustment of other parameters of the process steps (for example, the pressure), which could be achieved only with great effort, is avoided.

Further features are the subject of the dependent claims.

The invention is further explained with reference to the drawing figures of an exemplary embodiment.

The above-discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings.

DESCRIPTION OF THE PREFERRED EMBODIMENT

Figure 1:
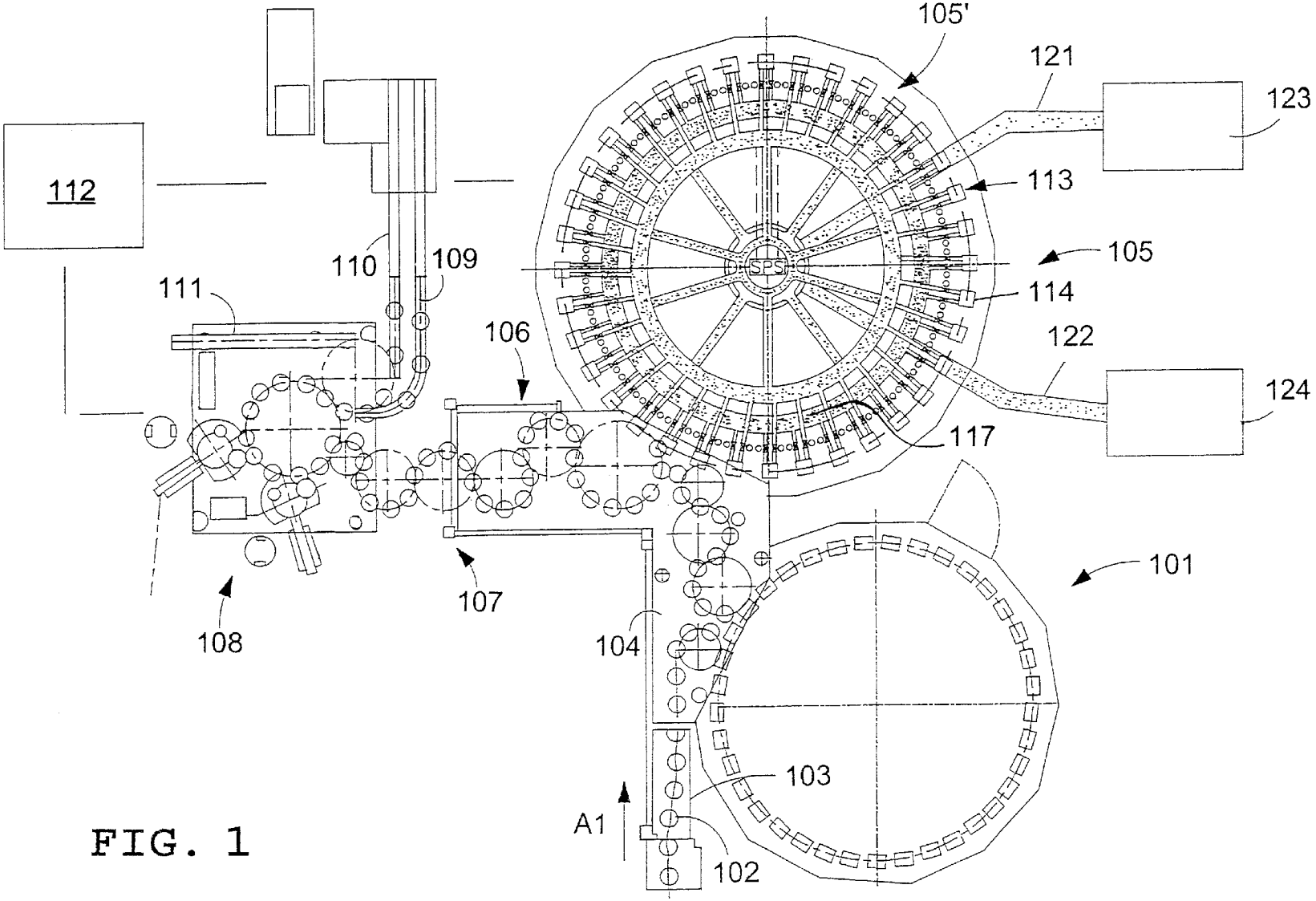
FIG. 1 shows a simplified overhead view of a system or machine for the simultaneous filling, closing and subsequent labelling of containers, namely bottles, with which the present invention can be utilized.

FIG. 1 shows one example of a system for filling containers which could possibly utilize the present invention.

FIG. 1 shows a rinser 101, to which the containers, namely bottles 102, are fed in the direction indicated by the arrow A1 by means of a conveyor line 103, and downstream of which, in the direction of travel, the rinsed bottles 102 are transported by means of a conveyor line 104 formed by a star wheel conveyor to a filling machine 105 or its inlet star wheel. Downstream of the filling machine 105, in the direction of travel of the bottles 102, there can preferably be a closer 106 which closes the bottles 102. The closer 106 can be connected directly to a labelling device 108 by means of a conveyor line 107 formed by a plurality of star wheel conveyors. In the illustrated embodiment, the labelling device 108 has three outputs, namely one output formed by a conveyor 109 for bottles 102 which are filled with a first product, from product mixer 123 through conduit 121 and are then labelled corresponding to this product, a second output formed by a conveyor 110 for those bottles 102 which are filled with a second product from product mixer 124 through conduit 122 and are then labelled corresponding to this product, and a third output formed by a conveyor 111 which removes any bottles 102 which have been incorrectly labelled.

In FIG. 1, 112 is a central control unit or, expressed differently, controller or system which includes a process controller which, among other things, controls the operation of the above-referenced system.

The filling machine 105 is preferably of the revolving design, with a rotor 105' which revolves around a vertical machine axis. On the periphery of the rotor 105' there are a number of filling positions 113, each of which consists of bottle carriers or container carriers (not shown, but compare element 5 in FIGS. 3 and 4), as well as a filling element 114 located above the corresponding container carrier. The toroidal vessel 117 is a component of the revolving rotor 105'. The toroidal vessel 117 can be connected by means of a rotary coupling and by means of an external connecting line 121 to an external reservoir or mixer 123 to supply the product, that is, product mix 1, for example.

As well as the more typical filling machines having one toroidal vessel, it is possible that in at least one possible embodiment of the present invention a filling machine could possibly be utilized wherein each filling element 114 is preferably connected by means of two connections to a toroidal vessel 117 which contains a first product (by means of a first connection, for example, 121) and to a second toroidal vessel which contains a second product (by means of the second connection, for example, 122). In this cases each filling element 114 can also preferably have, at the connections, two individually-controllable fluid or control valves, so that in each bottle 102 which is delivered at the inlet of the filling machine 105 to a filling position 113, the first product or the second product can be filled by means of an appropriate control of the filling product or fluid valves.

It will be understood that while a two-product assembly is illustrated in FIG. 1, that the invention is equally applicable to single-product installations, or other commensurate embodiments.

Figure 2:
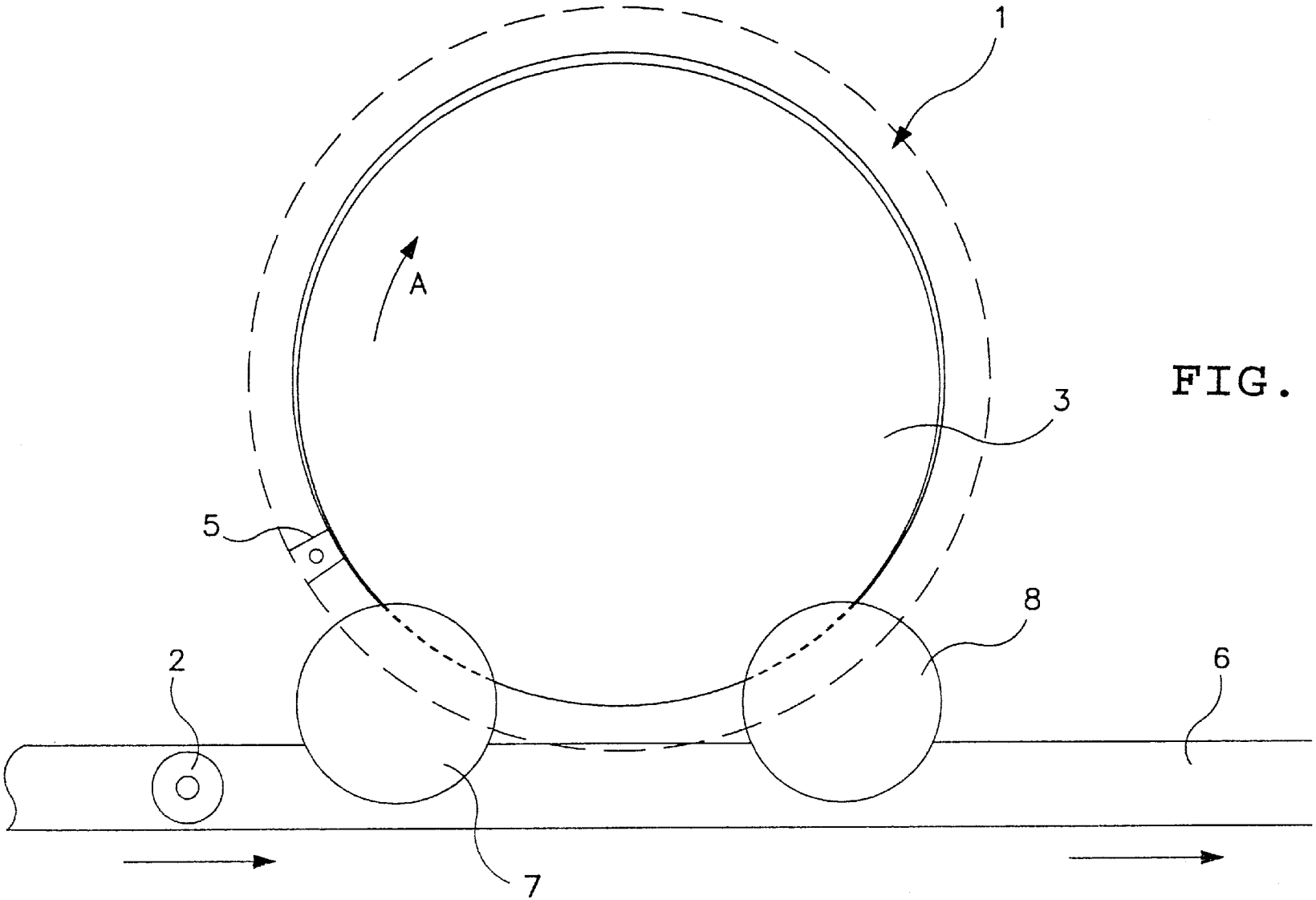
FIG. 2 is a largely simplified schematic representation and shows in plan view a filling machine according to the invention.

The filling machine shown in FIG. 2 is generally identified by the reference numeral 1 and it serves to fill containers, namely bottles 2, with a liquid filling material such as a beverage. The filling machine 1 comprises the type of revolving system of construction, that is, it has at a rotor 3 which, as is known to a person with skill in the art, rotates about a vertical machine axis, and it has a plurality of filling locations that are uniformly distributed in angular positions and these filling locations are respectively provided by one filling element 4 with a container carrier 5. The bottles 2 that are presented by a conveyor 6 are directed to the individual filling locations 4/5 by a bottle input or expressed differently, loading, portion 7 and the filled bottles 2 are removed at a bottle output or expressed differently, unloading, portion 8 from the filling locations 4/5 and they are returned to the conveyor 6. The rotor 3 is driven so as to rotate in the direction of arrow A in FIG. 2.

Figure 5:
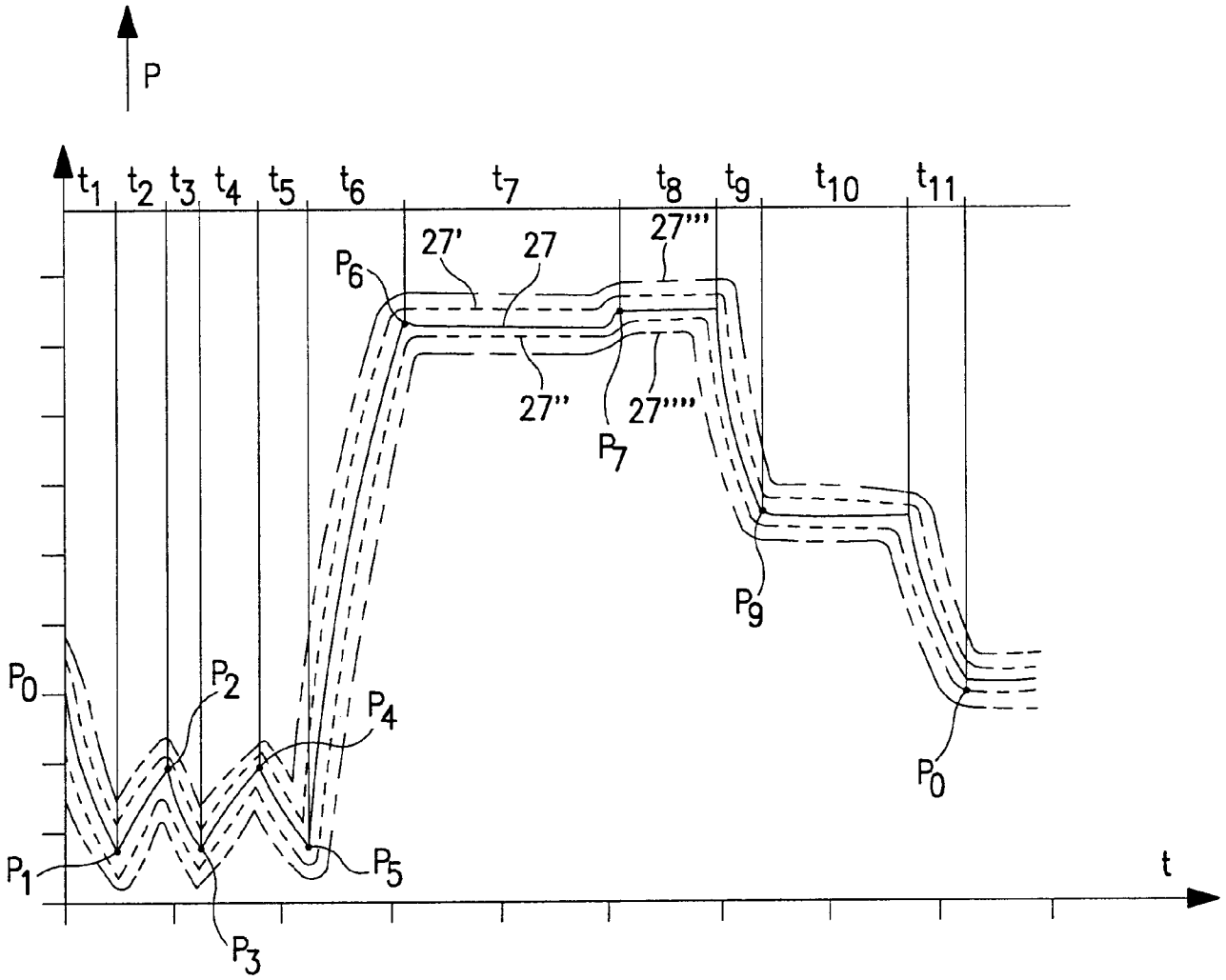
FIG. 5 is a diagram of the set point pressure behavior at a filling element of the filling machine of FIG. 2.

Between the bottle input portion 7 and the bottle output portion 8 there is carried out the filling process for the bottles 2 which are respectively lifted to a filling element 4, so as to be in sealing contact with this filling element and this filling process comprises several process steps, and particularly in the shown embodiment, diagrammatically shown in FIG. 5, in eleven steps. In this Figure is illustrated the pressure behavior or, expressed differently, the pressure course, (set point pressure behavior) of the pressure to be attained in the corresponding bottle 2 during the filling process, in conformity with time, and particularly as difference pressure with respect to the atmospheric pressure p0.

The filling process comprises particularly, accordingly, the following steps:

first evacuation of the corresponding bottle 2 from the surrounding or expressed differently, ambient, pressure to a pressure p1 during the time interval or, expressed differently, time period, (treatment time duration) t1;

first purging or, expressed differently, cleaning, washing, or rinsing, with an inert gas or $CO_2$ gas with a rise in pressure to a value p2 that is below the surrounding pressure during the time interval (treatment time duration) t2;

second evacuation to a pressure p3 that is below the pressure p2 during a time interval or, expressed differently, time period, (treatment time duration) t3;

second purging or, expressed differently, cleaning, washing, or rinsing, with an inert gas or $CO_2$ gas with a rise of pressure to the pressure p4 (still below the atmospheric pressure) during a time interval or, expressed differently, time period, (treatment time duration) t4;

third evacuation to a pressure p5 which is equal to or approximately equal to p1 during a time interval or, expressed differently, time period, (treatment time duration) t5;

pre-filling pressurization or, expressed differently, pre-tensioning, to the pre-filling pressurization or, expressed differently, pre-tensioning, pressure p6 that is markedly above the atmospheric or, expressed differently, ambient, pressure during a time interval or, expressed differently, time period, (treatment time duration) t6;

initiation of a fast filling at a pressure remaining substantially constant over a time interval or, expressed differently, time period, t7;

initiation of a slow filling phase with initially low pressure rise to the pressure p7 and then with a pressure remaining substantially constant for a time interval or, expressed differently, time period, of t8;

initiation of a pre-depressurization for a time interval or, expressed differently, time period, t9 with a pressure that drops to the value of p9;

initiation of a calming phase with substantially constant pressure p9 for a time interval or, expressed differently, time period, of t10; and release of the balance of pressure for a time interval or, expressed differently, time period, t11 with the pressure falling to the ambient pressure of p0.

A majority of the above-described process steps is controlled as to time. Individual process steps, namely, the conclusion of slow filling and, for example, the interface period between the fast filling and the slow filling are also controlled by a sensor.

Figure 3:
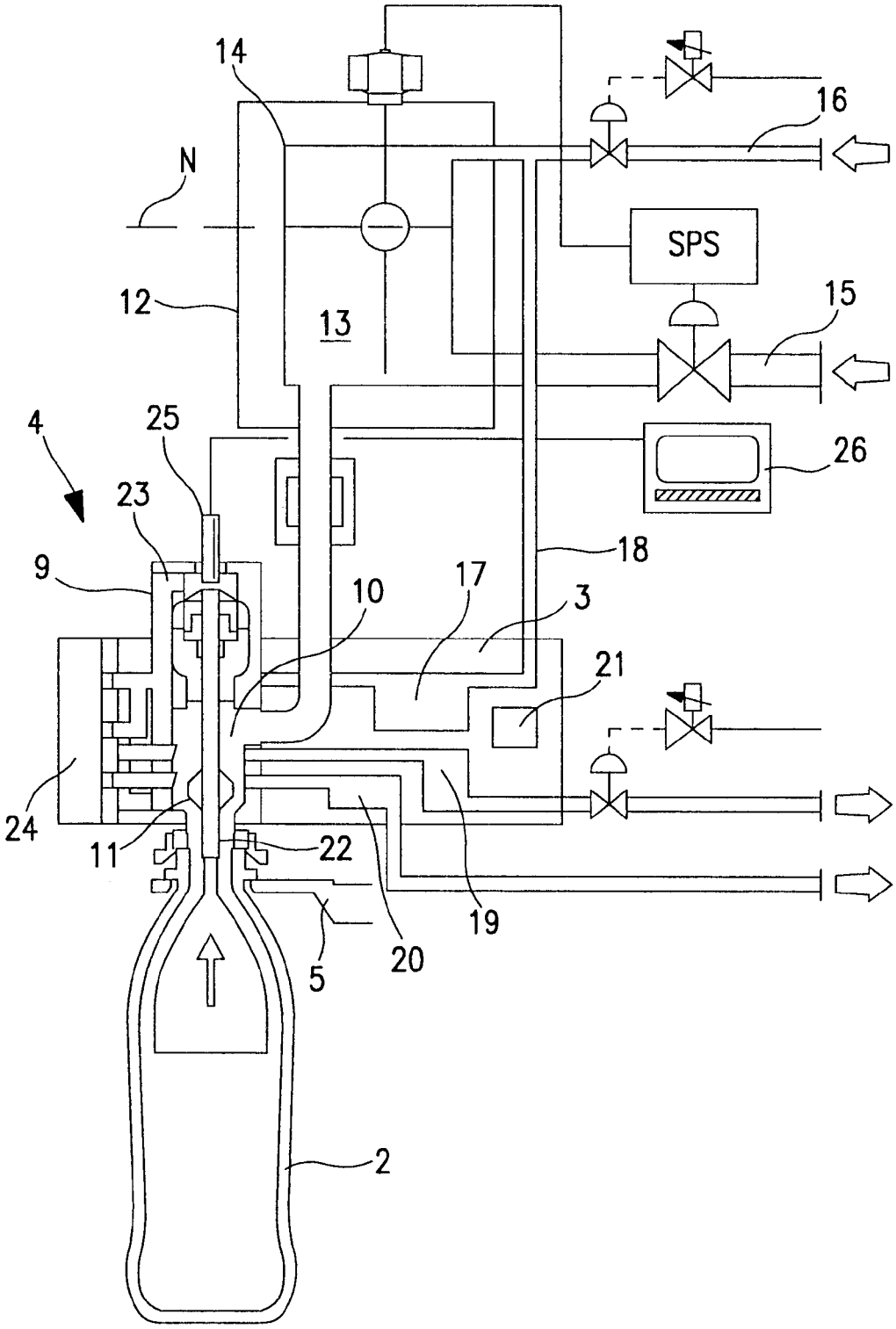
FIG. 3 is a simplified representation of a filling element of the filling machine according to FIG. 2.
Figure 4:
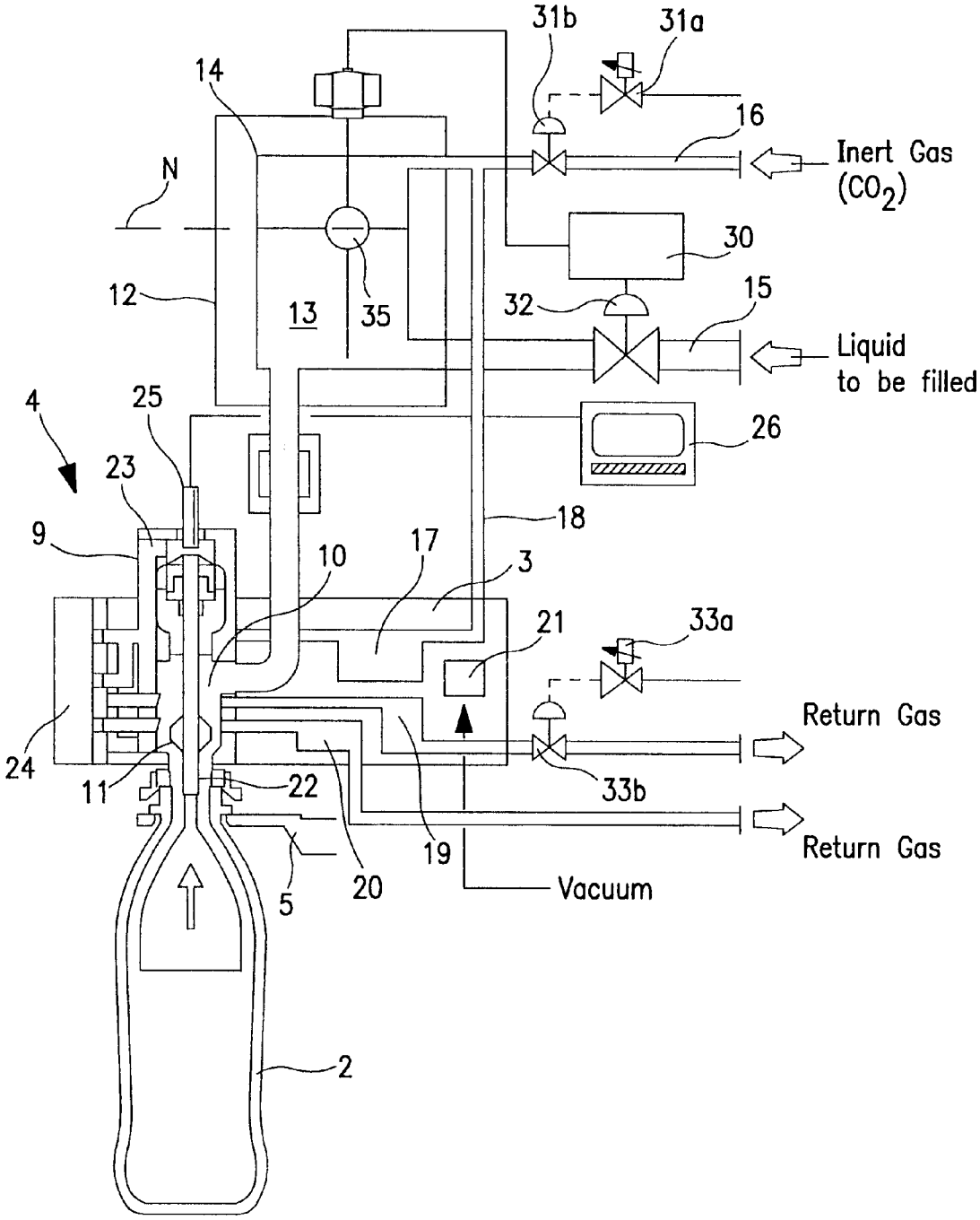
FIG. 4 is a view similar to FIG. 3 and showing additional details.

FIGS. 3 and 4 illustrate further the filling elements 4 provided at the rotor 3, particularly as filling element without a separate filling conduit. In the housing 9 of this filling element is first formed the fluid channel 10 in which is arranged, inter alia, the fluid valve 11 which is brought to the open state by an actuating device, not shown herein, for initiating the fast filling and at the conclusion of the slow filling it is closed; and in FIGS. 3 and 4 this valve is shown in its open position.

The fluid channel 10 is connected with a ring boiler 12 provided at the rotor 3 or, respectively, with a portion 13 for filling material. Above portion 13 for the filling material there is provided in the ring boiler 12 a gas space 14 for an inert gas under pressure, for example, $CO_2$ gas. The portion 13 for the filling material is fed, via a conduit 15, with liquid filling material and, particularly, in such a manner that the level N of the filling material in the ring boiler 12 is controlled to be at a pre-set or preselected value. The gas space 14 is supplied with the inert gas under pressure ($CO_2$ gas), and particularly in such a manner that by means of a pressure control, the pressure in the gas space 14 is constant, or substantially constant, or is approximately corresponding to pressure p7. Introduction of the inert gas is via tensioning gas conduit 16, or expressed differently, the gas conduit serves to pass a pre-filling pressurization medium or gas to the gas space 14.

The following components are provided at the rotor 3 for the individual treatment or filling phases in the shown embodiment for all filling elements 4:

an annulus channel 17 for the pressurization gas which channel is in communication, via a conduit 18, with the gas space 14, a first annulus channel 19 for return gas which channel serves the purpose of pre-depressurization and in which is controlled a pressure p9 which corresponds to the pre-depressurization pressure, a second annulus channel 20 for return gas for final depressurization or, expressed differently, for removal of the remaining balance of pressure which channel is in communication with the atmosphere, as well as a vacuum annulus channel 21 which is connected to a supply of vacuum, not shown.

Each filling element 4 has a return gas conduit 22 which reaches, when the bottle 2 is operatively connected to the filling element, with its lowermost open end into the interior space of the corresponding bottle 2 that is present and with its upper open end the conduit 22 is in communication with a gas channel 23 provided in the housing 9 which gas channel 23 is a component of gas passages formed in the housing 3. These gas passages can be controlled by means of a control valve device 24, one each for a filling element 4. The gas passages are individually controllable in such a way that the interior space of the corresponding bottle 2 that is positioned in sealing attitude or condition at the filling element 4 is connected, for the individual treatment steps, inter alia, with the corresponding gas annulus channel 17, 19, 20 and 21, respectively, of the corresponding treatment or process step and particular in such a manner that, in the event of steady state operation of the filling element 4, the in FIG. 5 illustrated set point pressure behavior is present during the filling.

A pressure sensor 25 is present in the gas channel 23 which sensor, via the return gas conduit 22, continuously collects data corresponding to the pressure in the interior space of the bottle 2 that is attached to the filling element 4, and which passes the corresponding measured value to an electronic unit, or expressed differently, a controller, 26 which is applicable in a supervisory manner or, expressed differently, in shared or common manner, for all filling elements 4 or, respectively, the pressure sensors 25 thereof; which electronic unit 26 is preferably computer-assisted or provided by a computer or, expressed differently a computing apparatus.

The term electronic unit or electronic unit 26 as used hereinabove and below, in at least one embodiment of the invention is to mean a computing unit or the like controller apparatus or electronic arrangement.

The pressure sensors 25 and the electronic unit 26 provide the opportunity to monitor and/or diagnose the individual filling elements 4 during the operation of the machine, that is, a possible error behavior of individual filling elements is recognized at an early stage and, as appropriate, counter measures can be initiated. Through use of the pressure sensors 25 and the common electronic unit or, expressed differently, the central controller, 26 these is attainable an automatic control of the filling process and which is specific to a given filling material or, expressed differently, the beverage at hand.

Monitoring and/or Diagnosis of the Filling Elements 4:

This diagnostic method is based on the recognition that solely by monitoring the actual or, expressed differently, the currently present pressure behavior that is monitored by the sensor 25 and through comparison of the measured pressure behavior at the corresponding filling element 4 with the set point value pressure behavior, any error in an individual filling element 4 can be recognized at an early point in time when the filling machine 1 is in the operating condition.

The set point value pressure behavior, which is illustrated by the curve bearing the reference numeral 27 in FIG. 5, is deposited in a memory of the electronic unit 26 and, in particular, with a narrow tolerance region, which region is defined in the illustration by the two curves 27' and 27" which are close to curve 27, as well as with a wider tolerance region, which is illustrated by the two outermost positioned curves 27'" and 27"". The bandwidth of the narrow tolerance range (curves 27' and 27") is selected in such a way that when the actual pressure behavior is fully within this bandwidth, qualitatively fully acceptable filling results are obtained, whereby, however, the electronic or electronic unit 26 already in the event of minor transgressions from the narrow tolerance range initiates an error message which contains the possible cause of the error and a precise identification of the corresponding filling element 4, for example, its running number or, expressed differently, its sequential number, at the rotor 3. The cause of error is analyzed by the electronic unit 26 by way of the position at which the pressure at the corresponding filling element 4 is digressing from the set point characteristic line, or, respectively, from the set point pressure behavior 27 or, expressed differently, digressing from the steady state condition. Errors within the narrow tolerance range as defined by the curves 27' and 27" are in any case within the quality concerns which are applicable for a vendable product. A corresponding error signal, however, can be used for preventive maintenance so as to prevent an error already in the initial phase, that is, prior to affecting the filling quality.

When the measured actual pressure behavior that is obtained at the filling element 4 by the there present pressure sensor 25 at any given point in time exceeds the broader tolerance range, which is defined by the curves 27'" and 27"", the quality is not commensurate with the characteristics of a vendable product. The electronic unit 26 recognizes the filling element 4 containing the error or, dressed differently, contains a fault, and then the bottle 2 of the corresponding filling element is sorted out in controlled manner by the electronic unit 26 to a removal system, not shown, or in the case of a grave error the filling machine 1 is brought to a full stop.

By means of the recognized or, expressed differently, the received, error message with precise definition of the error-containing filling element and the possible cause of error it will be possible for maintenance personnel to quickly remove the error. This is particularly then the case when there are not at hand serious deviations from the set point characterizing curve or, expressed differently, from the steady state condition, that is, curve 27 and it is possible, by means of the electronic unit 26, to control the corresponding filling element or, respectively, to control individual treatment or process steps at this filling element 4 in such a manner that errors that have arisen are at least corrected in their effect and this in particular through corresponding changes of the treatment time periods of individual process steps.

Such corrections and alignment measures allow the possibility to maintain the filling element within the still acceptable tolerance with correct filling results. When, for example, during the pre-tensioning or, expressed differently, pre-pressurization, time to at a filling element 4 the necessary filling pressure or pre-tensioning or, expressed differently, the pre-pressurization, pressure is not fully attained, the electronic unit 26 can correspondingly extend the pre-tensioning time t6 in corresponding manner during the next filling process. With this correction of the treatment time periods, filling elements 4 having minor defects can be used with qualitatively acceptable filling results until the next routine maintenance cycle of the entire filling machine.

The described diagnostic system or, respectively, the electronic unit 26, of course, also includes the option to illustrate all relevant data, especially also the data obtained by the pressure sensors 25 such that these data can be subjected to data processing and they can be evaluated accordingly.

It will be obvious that the set point pressure behavior 27 as well as also data which correspond to the narrow tolerance range (curves 27' and 27") and the wider tolerance range (curves 27'" and 27"") and values for respectively different treatment and filling processes and for different filling parameters, such as: filling material type, $CO_2$ content, filling temperature, filling volume, empty volume of the containers, filling height, and so on can be stored separately.

The corresponding set point pressure behavior 27 with its tolerance ranges can be read into the electronic unit 26 by corresponding input of data. Preferred is that the electronic unit 26 calculates, at commencement of production, on the basis of the data passed by the pressure sensors 25, a pressure behavior characteristic line or, expressed differently, steady state characteristic, which is calculated from the averaged values of a predetermined quantity of fillings at the filling elements 4 of the filling machine 1. This pressure behavior characteristic line is then further used as set point pressure behavior 27.

Automatic Paramterization and Control of the Filling Process:

The electronic diagnostic system which comprises the pressure sensors 25 and the common supervisory electronic unit 26 can also be utilized for the purpose of setting parameters and control of the filling process as a function of filling parameters. Such filling parameters, for example, include:

- type of the filling material, or, respectively, type of beverage,
- content of $CO_2$,
- filling temperature,
- filling volume,
- empty volume of the corresponding container or, respectively, the bottle,
- filling height,
- filling method (for example, filling without pressure, filling under pressure, single or repeated evacuation with an inert gas, intermediate purging or, expressed differently, cleaning, washing, or rinsing, steam treatment, and so forth).

The above-mentioned parameters not only require, inter alia, in their quantity and/or type differing method steps, but also and in particular a definitive period of time and a predetermined pressure behavior in the corresponding method step. The course of the method is deposited for a corresponding filling method in the memory of the electronic unit 26. There are also included the parameters and characterizing lines for the filling material at hand or, respectively, for the beverage and the container 2 that is to be filled, from which characterizing lines or expressed differently, steady state curves, the individual process pressures, the time sequence, the treatment times, and so forth for the corresponding method sections will be calculated or computed.

Such characterizing lines are, for example:

- the evacuation time t1 or t3 as a function of the volume of the bottles 2 to be filled,
- the time of pre-tensioning or, expressed differently, pre-filling pressurization, t6 as a function of the filling pressure p7 and the volume of the bottles 2 to be filled,
- the time of pressure release as a function of volume of the gas space within the filled bottles 2 above the level of the filling material, the starting pressure and the diameter of the pressure release nozzles present in the filling elements 4,
- the filling pressure as a function of the prevailing filling material (beverage), the content of $CO_2$, and the filling temperature,
- the return gas and pre-depressurization pressure as a function of the filling material (beverage, content of $CO_2$, and filling temperature).

Thus, an operator may input the following data for a filling cycle;

| | |
|---|---|
| beverage: | beer |
| content of $CO_2$: | 5.5 grams per liter |
| filling temperature: | 12 degrees Celsius |
| bottle content: | 0.5 liter |
| filling height: | 50 millimeter. |

It will be understood that the filling height may refer to the empty height above the liquid level in a corresponding container.

Principally, the control may also be embodied in such a manner that the electronic unit or, expressed differently, computing unit, 26 on input of data representative of type of filling material or, respectively, type of beverage, selects or proposes a filling method with a progress which is optimal for this type of beverage.

The same five data items can be utilized by the electronic unit 26 to carry out, with the aid of stored data, all adjustments required for the control of the individual method steps, namely:

| | |
|---|---|
| time period | first evacuation |
| time period | first purging/washing |
| time period | second evacuation |
| time period | second purging/washing |
| time period | third evacuation |
| time period | partial pre-pressurization |
| time period | pre-pressurization |
| time period | pre-depressurization |
| time period | final depressurization |
| time period | filling pressure |
| time period | pre-depressurization pressure |

level N of the filling material in the ring boiler 12.

The filling times t7 and t8 are provided due to control by the sensors from the filling height measurement or, respectively, from the determination of the volume at hand, The control is done in detail in such a manner that the filling machine 1 initially commences the filling operation with values which the electronic unit 26 has calculated or computed from stored process parameters under consideration of the adjustment made by the operator. During operation, the electronic unit 26 compares the pressures which have been attained in the individual method steps and which were sensed by the pressure sensors 25 with values to be utilized in steady state operations or, expressed differently, set point values of pressure (set point pressure behavior). In the event of a discrepancy between the actual value and the set point value the electronic unit 26 carries out appropriate corrections as to time and this is done until the optimal filling process has been achieved. This automatic setting of parameters (paramterization) of the course of the operation of the filling process does not require detailed knowledge of the filling process by the operator. The operator needs only to input the data in conformity with generally known data as to beverage, inclusive of the type and size of the container to be filled or, respectively, bottles to be filled.

The invention has been described in the foregoing at hand of an embodiment. It will be clear that modifications and changes are possible without departing from the underlying inventive thought.

Thus, it is possible to detect, with the aid of pressure sensors installed in each filling valve, defective bottles due to the arisen pressure drop in the system. Bottles made of PET often have small holes. Such defects can be determined by pressure measurements directly prior to pre-tensioning or, expressed differently, pre-pressurization, and as result one could terminate the filling process. When such bottles are filled under pressure, the beverage escapes in jets and soils the entire region around the filling machine. PET bottles or containers include containers made of polyethylene terephthalate $(C_{10}H_5O_4)_x$, having Chemical Abstract Service code No. 25038-59-9, and comprising a thermoplastic polyester formed from ethylene glycol by direct esterification or by catalyzed ester exchange between ethylene glycol and dimethyl terephthalate.

Furthermore, with the aid of a pressure measurement one can determine whether or not a bottle is at all present at the filling location.

The embodiment illustrated in FIG. 4 comprises a central controller 26 which controls, inter alia, control valves 31*a* and 31*b* for inert gas, such as $CO_2$, that is being passed through conduit 16; control valve 32 for liquid to be filled that is being passed through conduit 15; and control valves 33*a* and 33*b* for return gas from rotor 3. The controller 26 may also be in communication with a stored program controller 30 and a level sensor/control 35 as well as with control valve 34.

Figure 6:
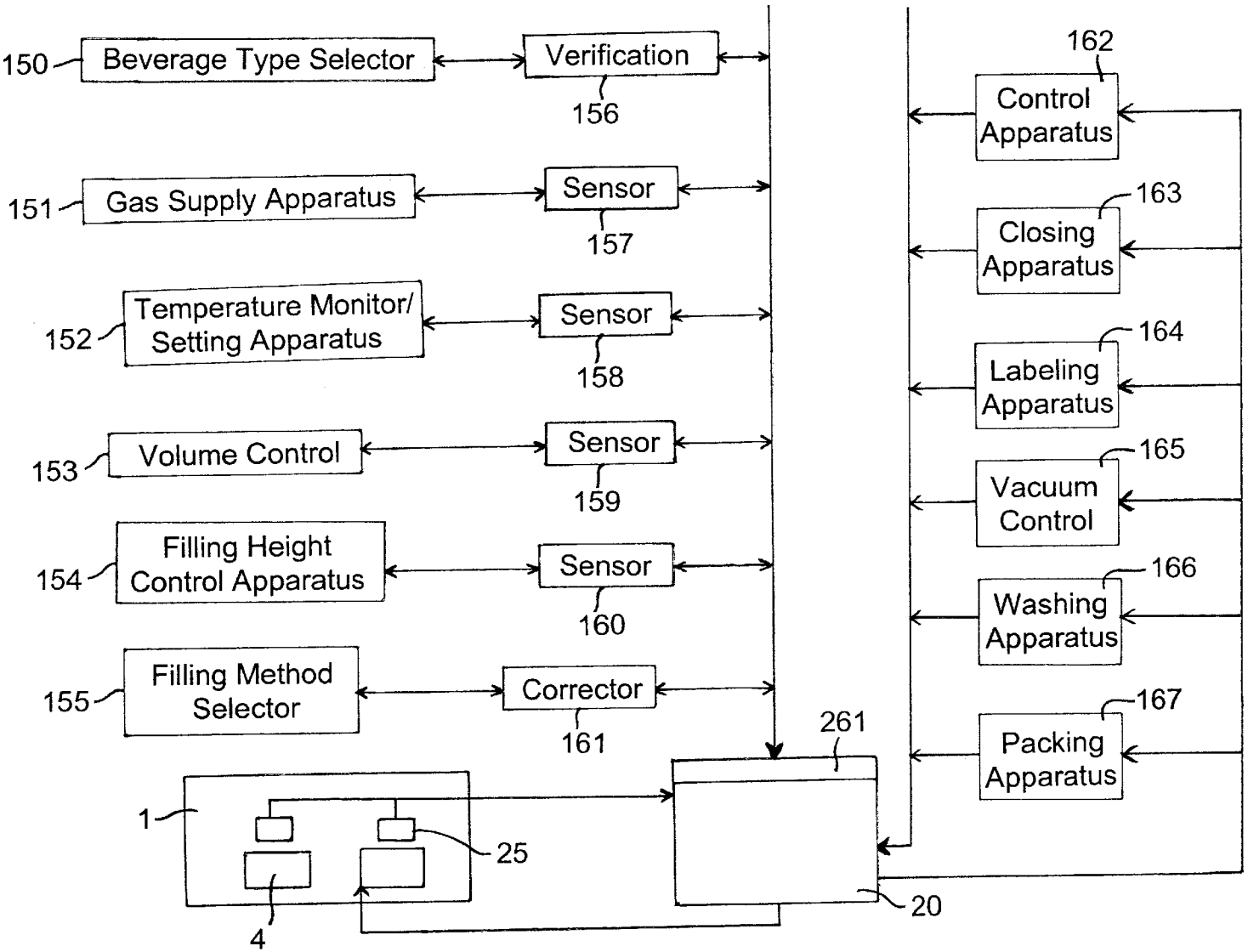
FIG. 6 is a simplified block diagram showing schematically the control of a filling machine and associated equipment.

The embodiment illustrated in FIG. 6 comprises a filling machine 1 with filling elements 4 at each of which is connected a sensor 25 which passes the sensed pressure indication to a controller 26. The controller 26 may possibly comprise in at least one embodiment of the invention a computing apparatus such as a microprocessor computing apparatus, with at least a storage memory or storage arrangement 26'. This storage arrangement 26' is configured to store data in conformity with equipment such as beverage type selector apparatus 150, in association with a verification apparatus 156; gas ($CO_2$) supply apparatus 151, in association with a sensor 157; temperature control apparatus 152, in association with a sensor 158; volume control apparatus 153, in conjunction with a sensor 159; filling height control apparatus 154, in association with a sensor 160; and a filling method selector 155, in conjunction with a corrector 161, as required.

The arrangement of FIG. 6 also comprises equipment under interaction with controller 26, such as a control apparatus 162 which may be a stored program control apparatus, apparatus 163 for closing filled containers, a labelling apparatus 164, vacuum pump control 165, washing apparatus 166 and packing or containerization apparatus 167.

Examples of apparatus and procedures to measure carbon dioxide ($CO_2$) content or concentration and which may possibly be incorporated in embodiments of the present invention may be found in: U.S. Pat. No. 4,801,551 issued to Byers et al. on Jan. 31, 1989 and entitled "Rugged dissolved carbon dioxide monitor for high purity water"; U.S. Pat. No. 5,029,103 issued to Carbide on Jul. 2, 1991 and entitled "Carbon dioxide monitor"; U.S. Pat. No. 5,068,090 issued to Connolly on Nov. 26, 1991 and entitled "Aqueous carbon dioxide monitor"; and U.S. Pat. No. 5,252,491 issued to Connolly on Oct. 12, 1993 and entitled "Aqueous carbon dioxide monitor", all of these U.S. patents being hereby expressly incorporated by reference herein.

Examples of apparatus and methods for sensing or measuring temperature parameters and which may possibly be utilized in connection with the present invention are to be found in: U.S. Pat. No. 4,038,873 issued to Kimmel on Aug. 2, 1977 and entitled "Temperature monitor and indicator"; U.S. Pat. No. 4,278,841 issued to Regennitter et al. on Jul. 14, 1981 and entitled "Multiple station temperature monitor system"; U.S. Pat. No. 4,623,265 issued to Poyser on Nov. 18, 1986 and entitled "Transformer hot-spot temperature monitor"; U.S. Pat. No. 4,802,772 issued to Chianese on Feb. 7, 1989 and entitled "Nonelectric temperature monitor"; U.S. Pat No. 5,469,855 issued to Pompei et al. on Nov. 28, 1995 and entitled "Continuous temperature monitor"; U.S. Pat. No. 5,511,415 issued to Nair et al. on Apr. 30, 1996 and entitled "Gas flow and temperature probe and gas flow and temperature monitor system including one or more such probes"; U.S. Pat. No. 5,531,191 issued to Davis on Jul. 2, 1996 and entitled "Fluid temperature monitor"; U.S. Pat. No. 5,563,239 issued to Pompei et al. on Aug. 5, 1997 and entitled "Continuous temperature monitor"; U.S. Pat. No. 5,662,419 issued to Lamagna on Sep. 2, 1997 and entitled "Time-temperature monitor and recording device and method for using the same"; U.S. Pat No. 5,708,412 issued to Proulx on Jan. 13, 1998 and entitled "Fluid level and temperature monitor and alarm system"; and U.S. Pat. No. 5,890,100 issued on Mar. 30, 1999 to Crayford and entitled "Chip temperature monitor using delay lines", all of these U.S. patents being hereby expressly incorporated by reference herein.

Examples of apparatus and methods for determining parameters such as the filling volume, the empty volume, and the filling height which may possibly be utilized in embodiments of the present invention may be found in: U.S. Pat. No. 4,134,407 issued to Elam on Jan. 16, 1979 and entitled "External pressure-volume monitor"; U.S. Pat No. 4,282,757 issued to Cohn on Aug. 11, 1981 and entitled "Device for detecting rate of change in pressure"; U.S. Pat. No. 4,391,412 issued to Goldhammer on Jul. 5, 1983 and entitled "Apparatus for limiting filling height of containers"; U.S. Pat. No. 4,765,342 issued to Urman et al. on Aug. 23, 1988 and entitled "Timed drift compensation for rate volume monitor"; U.S. Pat. No. 4,788,456 issued to Urman et al. on Nov. 29, 1988 and entitled "Variable threshold for rate volume monitor"; U.S. Pat. No. 4,928,687 issued to Lampotang et al. on May 29, 1990 and entitled "$CO_2$ diagnostic monitor"; U.S. Pat. No. 5,008,653 issued to Kidd et al. on Apr. 16, 1991 and entitled "Fluid detector with overfill probe"; U.S. Pat. No. 5,110,208 issued to Sreepada et al. on May 5, 1992 and entitled "Measurement of average density and relative volumes in a dispersed two-phase fluid"; U.S. Pat. No. 5,244,550 issued to Inoue on Sep. 14, 1993 and entitled "Two liquid separating methods and apparatuses for implementing them"; U.S. Pat. No. 5,279,157 issued to Mattis et al. on Jan. 18, 1994 and entitled "Liquid level monitor"; and U.S. Pat. No. 6,099,470 issued to Bahr on Aug. 8, 2000 and entitled "Monitor for diffusable chemical substance", all of these U.S. patents being hereby expressly incorporated by reference herein.

Examples of apparatus and/or methods which may possibly be incorporated in a possible embodiment of our present invention that may possibly work under the control of pneumatic pressure may be found in: U.S. Pat. No 4,044,732 issued to Inada et al. on Aug. 30, 1977 and entitled "Pneumatic control system and pressure responsive valve assembly therefor"; U.S. Pat. No. 4,576,194 issued to Lucas et al. on Mar. 18, 1986 and entitled "Pneumatic control system, control means therefor and method of making the same"; U.S. Pat. No. 4,679,583 issued to Lucas et al. on Jul. 14, 1987 and entitled "Pneumatic control system, control means therefor and method of making the same"; U.S. Pat. No. Re. 34,202 issued to Kautz on Mar. 30, 1993 and entitled "Dual mode pneumatic control system"; U.S. Pat. No. 5,642,271 issued to Henderson on Jun. 24, 1997 and entitled "Pneumatic control system"; U.S. Pat. No. 5,816,132 issued to Langner et al. on Oct. 6, 1998 and entitled "Load-sensing pneumatic control system"; and U.S. Pat. No. 6,129,002 issued to Lisec et al. on Oct. 10, 2000 and entitled "Valve arrangement, especially for a pneumatic control system", all of these U.S. patents being hereby expressly incorporated by reference herein.

Examples of apparatus and/or methods which may possibly be incorporated in a possible embodiment of our present invention that may possibly work under the control of hydraulic pressure may be found in: U.S. Pat. No. 5,513,551 issued to Morishita on May 7, 1996 and entitled "Hydraulic control system"; U.S. Pat No. 5,579,642 issued to Wilke et al. on Dec. 3, 1996 and entitled "Pressure compensating hydraulic control system"; U.S. Pat. No. 5,718,115 issued to Burkner on Feb. 17, 1998 and entitled "Constant force hydraulic control System"; U.S. Pat. No. 5,758,499 issued to Sugiyama et al. on Jun. 2, 1998 and entitled "Hydraulic control system"; U.S. Pat. No. 5,832,729 issued to Reid et al. on Nov. 10, 1998 and entitled "Hydraulic control system"; U.S. Pat. No. 5,921,165 issued to Takahashi et al. on Jul. 13, 1999 and entitled "Hydraulic control system"; and U.S. Pat. No. 6,062,331 issued to Grunow et al. on May 16, 2000 and entitled "Auxiliary hydraulic control system for a work machine", all of these U.S. patents being hereby expressly incorporated by reference herein.

The filling process comprises particularly, accordingly, in accordance with one possible embodiment of the invention as will next be described with reference to FIG. 7, the following process steps:

step 201—this steps comprises a first evacuation of the corresponding bottle 2 from the surrounding or ambient pressure to a pressure with value p1 during the time period (treatment time duration) of t1;

step 202—this step comprises a first purging or washing with an inert gas or $CO_2$ gas with a rise in pressure to a pressure with value p2 that is below the surrounding pressure during the time (treatment time duration) of t2;

step 203—this step comprises a second evacuation to a pressure p3 that is below the pressure p2 during a time (treatment time duration) of t3;

step 204—this step comprises a second purging or washing with an inert gas or $CO_2$ gas with a rise of the pressure to the pressure with value p4 (still below the atmospheric pressure) during a time (treatment time duration) of t4;

step 205—this step comprises a third evacuation to a pressure with value p5 that is equal to or approximately equal to pressure p1 during a time (treatment time duration) of t5;

step 206—this step comprises subjecting a corresponding container to a pre-filling pressurization to the pre-filling pressurization pressure with the value p6 that is markedly above the atmospheric pressure during a time (treatment time duration) of t6;

step 207—this step comprises initiation of a fast filling phase at a pressure remaining substantially constant over a time of t7;

step 208—this step comprises initiation of a slow filling phase with an initially gradual (low) pressure rise to the pressure with value p7 and then with a pressure remaining substantially constant for a time of t8;

step 209—this step comprises initiation of pre-depressurization pressure for a time of t9 with a pressure that drops to the value of p9;

step 210—this step comprises initiation of a calming phase with substantially constant pressure with value p9 for a time of t10; and step 211—this step comprises the release of the balance-pressure for a time of t11 with the pressure falling to the ambient pressure with the value of p0.

Figure 8:
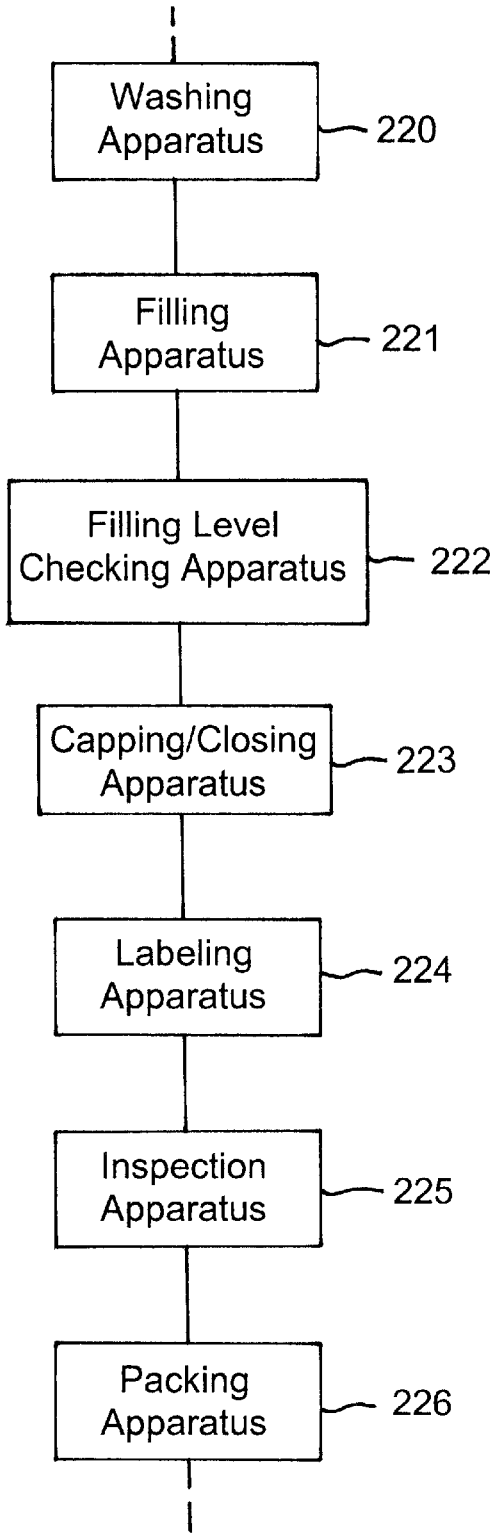
FIG. 8 is a diagram showing equipment for a plant filling bottles with a beverage.

FIG. 8 is illustrates one possible plant for filling beverage containers, comprising a washing apparatus 220, a filling apparatus 221, for filling beverage containers, filling level checking apparatus 222, and capping or closing apparatus 223. The closed beverage containers can be labelled in a labelling apparatus 224 and thence passed to inspection apparatus 225 from whence they can be passed to packing, for example, for placing in a crate, apparatus 226.

One feature of the invention resides broadly in the system for filling bottles, cans, or the like containers 2, with a liquid filling material, with the system comprising a plurality of filling positions, each comprising a filling element 4 at which the corresponding container 2, at least during a portion of the filling process, is positioned with its filling opening in sealing position and by means of which filling element the interior space of the container is acted upon with at lease one process pressure during the filling process in at least one process step, characterized thereby that at each filling element 4 there is provided at least one pressure sensor 25 which collects, during the filling process, the pressure in the interior space of the container 2 that is connected with the filling element 4 and delivers an electrical signal in conformity with this pressure to an electronic unit 26 which is common to all filling elements 4.

Another feature of the invention resides broadly in the system characterized thereby that the electronic unit comprises a computer-assisted electronic unit or a computer.

Yet another feature of the invention resides broadly in the system characterized thereby that the pressure sensors 25 capture, on an individual basis, the pressure behavior of each filling element 4 as to time during the filling process and that the electronic unit 26 compares this actual pressure behavior with a set point pressure behavior 27 or, respectively, compares the prevailing actual pressure with the associated set point pressure which is resulting from the set point pressure behavior which set point pressure is stored, in a manner specific to the filling material, in a memory of the electronic unit 26.

Still another feature resides broadly in the system characterized thereby that the electronic unit 26 provides, in the event of a difference, between the actual pressure and the set point value 27, which exceeds a first tolerance limit 27', 27", an error signal which comprises at least one identification of the corresponding filling element.

A further feature of the invention resides broadly in the system characterized thereby that in the event of a difference, between the actual value and the set point value, which exceeds a pre-set second tolerance limit 27'", 27"", the electronic unit initiates an error signal which includes the identification of the corresponding filling element and which causes a shutting-off of the filling machine and/or a removal of the container 2 at the corresponding filling element.

Another feature of the invention resides broadly in the system characterized thereby that the electronic unit 26 produces, in the event of a difference, between the set point value and the actual value that is being determined at a filling element, a difference signal for correcting the corresponding process step, particularly for correcting the duration of the process step.

Yet another feature of the invention resides broadly in the system characterized thereby that the set point value, as well as the associated tolerance limits 27', 27", 27'", 27"", are embedded, in a manner specific to varying filling materials, for the at least one process step, in the memory of the electronic unit 26.

Still another feature of the invention resides broadly in the system characterized thereby that for filling processes with a plurality of process steps the entire desired pressure behavior is stored as actual value in the memory of the electronic unit 26 and, in particular, together with the associated tolerance limits.

A further feature of the invention resides broadly in the system characterized thereby that the filling machine comprises such a revolving type of structure in which the filling elements 4 are provided at the circumference of a rotor that rotates about a machine axis.

Another feature of the invention resides broadly in the system characterized thereby that the corresponding set point value, or, respectively, the corresponding set point pressure behavior is produced in each filling portion thereby that the electronic unit 26 initially calculates or computes from the signals produced by the pressure sensors 25 a pressure behavior characteristic curve (steady state characteristic) and, in particular, by averaging of the pressure signals which the various filling elements 4 deliver in conformity with their corresponding process steps.

Yet another feature of the invention resides broadly in the system characterized thereby that the electronic unit determines and/or calculates or computes, under consideration of data specific to filling material and/or container, as well as under consideration of parameters preferably stored in the memory in beverage and container dependent manner, the set point pressure behavior and the electronic unit produces, based on the comparison, between the set point pressure behavior and the actual pressure behavior, a signal for correcting the filling process, or generates an error message.

Still another feature of the invention resides in the system characterized thereby that the at least one pressure sensor 25 of each filling element 4 is provided at a gas channel 23 formed in the filling element 4, which gas channel is in communication with the interior space of the container 2 that is positioned at he filling element 4.

A further feature of the invention resides broadly in the system characterized thereby that the gas channel 23 in which the pressure sensor 25 is arranged, comprises that return gas channel 23 which is connected with a return gas conduit 22 of the filling element 4.

Another feature of the invention resides broadly in a method for filling of bottles, cans, or the like containers 2, with a liquid filling material, with the use of several filling positions, each comprising a filling element 4 at which the corresponding container 2 is positioned in sealing relation with its container mouth during at least a portion of the filling process and by means of which filling element the interior space of the container is impacted in at least one process step with at least one process pressure during the filling process, characterized thereby that at each filling element 4 during the filling process the pressure in the interior space of the container 2 that is connected with the filling element 4 is individually collected and that electrical signals in conformity with the pressures are passed to an electronic unit 26 which is common to all filling elements 4.

Yet another feature of the invention resides broadly in the method characterized thereby that respectively the pressure behavior with respect to time during the filling process is individually collected for each filling element 4 and that the electronic unit 26 compares this actual pressure behavior with a pre-set pressure behavior 27 or, respectively, compares the prevailing actual pressure with that associated set point pressure that results from the set point pressure behavior, and which set point pressure is deposited in a memory of the electronic unit 26 in a manner which is specific to the filling material.

Still another feature of the invention resides broadly in the method characterized thereby that the electronic unit 26, in the event of a difference, between the actual pressure and the set point 27, which exceeds a first tolerance limit 27', 27", provides an error signal which comprises at least one identification of the corresponding filling element.

A further feature of the invention resides broadly in the method characterized thereby that in the event of a difference, between the actual value and the set point value, which exceeds a pre-set second tolerance limit 27'", 27"", the electronic unit initiates an error message which comprises the identification of the corresponding filling element and which causes shutting-off of the filling machine and/or removal of the container 2 present at the corresponding filling element.

Another feature of the invention resides broadly in the method characterized thereby that the electronic unit 26 produces, in the presence of a difference, between the set point value and the actual value that is measured at the filling element, a signal in conformity with the difference, for correcting the corresponding process step, particularly for correcting the time of duration of the process step.

Yet another feature of the invention resides broadly in the method characterized thereby that the pre-set value as well as the associated tolerance limits 27', 27", 27'", 27"", are deposited in the memory of the electronic unit 26, respectively specific for varying filling material types and specific for the at least one process step.

Still another feature of the invention resides broadly in the method characterized thereby that for filling methods with a plurality of method steps the entire desired pressure behavior as to time is stored as actual value in the memory of the electronic unit 26 and particularly together with the associated tolerance limits.

A further feature of the invention resides broadly in the method characterized thereby that the corresponding pre-set value or, respectively, the corresponding set point pressure behavior is formed, during each new filling portion, thereby that the electronic unit 26 initially calculates or computes, from the signals delivered by the pressure sensors 25, a pressure behavior characteristic curve (steady state characteristic) and, particularly preferred through averaging of those pressure signals that are initiated by the various filling elements 4 in respectively corresponding method steps.

Another feature of the invention resides broadly in the method characterized thereby that the electronic unit, under consideration of preselected or input data representative of filling material and/or container, as well as under consideration of preferably in the memory of the electronic unit deposited liquid and container dependent parameters, determines the set point pressure behavior and/or calculates or computes and produces, from the comparison, between set point pressure behavior and the actual pressure behavior, a signal to correct the filling process or an error signal.

Yet another feature of the invention resides broadly in the method characterized thereby that there is measured the respectively prevailing pressure in a gas channel 23 formed in the filling element 4, which is in communication with the interior space of the container 2 that is positioned at the filling element 4.

The features disclosed in the various publications, disclosed or incorporated by reference herein, may be used in the embodiments of the present invention, as well as, equivalents thereof.

The appended drawings in their entirety, including all embodiments dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 100 08 426, filed on Feb. 23, 2000, having inventors Ludwig CLÜSSERATH and Manfred H ÄRTEL, and DE-OS 100 08 426 and DE-PS 100 08 426, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

While our invention has other applicability, our present invention has most applicability in machinery of KHS Maschinen-und Anlagenbau Aktiengesellschaft of Dortmund, Federal Republic of Germany, and such machinery may be viewed on the company's website under www.khs-ag.de, particularly under www.khs-ag.de/en/05products/lmachines.

The website shows aspects of cleaning technology (INNOCLEAN), namely, single-end bottle washers of which there are three versions of the INNOCLE single-end bottle washer. The machines offered range from the lowest capacity (INNOCLEAN EC) with an output of 10,000 bottles per hour, the mid-capacity of 10,000 to 30 000 bottles per hour (INNOCLEAN EK), to machines with capacities for 150,000 bottles per hour (INNOCLEAN EE+INNOCLEAN EM, also available as multiple bath versions) All models have been designed for washing returnable and non-returnable glass and PET bottles. Double-end bottle washers: the INNOCLEAN DM double-end, multiple-bath bottle washer is designed for the mid to high capacity range of up to 150,000 bottles per hour. This machine fulfills the highest possible bottle requirements by consistently separating the impurities from the clean bottle discharge. Very long treatment periods can be achieved by combining a series of various types of caustic baths. The INNOCLEAN DM is available in various overall heights. The INNOCLEAN DMT product line machines are double-end bottle washers with modified automation. Crate washers: the INNOCLEAN KW is a fully automatic washing system for plastic crates. Made entirely of stainless steel, single or two-vat versions are available of these single and double-track machines. Capacities range from 500 to 10,000 crates per hour. Crates are washed by two optional types of high-pressure spraying: 1. hot water and follow-up spraying, 2. caustic spraying, hot water and follow-up spraying.

Washing and filling technology for kegs—INNOKEG: comprising keg washers and fillers—whether the INNOKEG RF-SU for the lower capacity range or the linear INNOKEG RF-MP and RF-DP (single and double-conveyor versions) for the mid and upper capacity range, the tried and tested INNOKEG RF product line is the center of attention of the KHS keg systems for the beverage industry. Keg interior cleaning, sterilization, and keg filling is performed fully automatically. Ideal for filling carbonated and non-carbonated beverages such as beer, soft drinks, mineral water, wine and fruit juices. Rotary fillers; the INNOKEG KR is continuous operation (rotary-type) keg treatment machine-filler. It is suitable for filling kegs and containers equipped with central fitting systems and ideal for filling carbonated and non-carbonated beverages such as beer, juice, mineral water, wine and fruit juices, The INNOKEG KR is available in four capacity ranges; up to 600 kegs per hour, filler with 16 filling elements; up to 800 kegs per hour, filler with 20 filling elements; up to 1,000 kegs per hour, filler with 24 filling elements. More than 1,000 kegs per hour, filler with 32 filling elements. Pre-treatment and checking: the INNOKEG product line offers several machine models for pre-treatment and checking of kegs: 1. the INNOKEG AR keg exterior washer, a completely covered tunnel machine for treatment of keg exteriors (capacity 60 to 1,200 kegs per hour); 2. the multiple head INNOKEG MK used for checking the condition of kegs such as cap stripper and check re-tightener, residual pressure check as well as optical distortion checking 70–1,100 kegs per hour capacity (depending on the equipment). Keg handling machines: KHS has a number of keg handling machines in its INNOKEG program: from protective cap cappers and decappers (INNOKEG PM-BK/PM-EK) to the keg program turner (INNOKEG PM-PW) for repositioning horizontally palletized kegs so that fittings point inward or outward. This product line is rounded off by the double-cross keg turner (INNOKEG PM-DW), the keg constant turner (INNOKEG PM-SW) which turns all kegs 180 degrees after filling, and the keg control turner (INNOKEG PM-KW).

Inspection technology (INNOCHECK): empty bottle inspectors: the INNOCHECK LF product line from KHS offers a wide variety of state-of-the-art devices and machines for inspecting returnable glass or PET packaging. Capacities range from 36,000 to 72,000 bottles per hour. High-tech camera technology and tried and tested sensory testing systems, among others, are implemented for the following methods of inspection; bottle height checking, sealing surface, IR residual liquids check, inner side walls, camera base. Foreign substance inspectors: the INNOCHECK FS is a highly dependable foreign substance inspector for inspecting PET multi-use bottles against contamination with taste and health affecting materials. The inspector has a low error return rate and a strong recognition rate and is resistant to parameter charges such as temperature fluctuation, air humidity and unclean air. The INNOCHECK FS operates with a velocity of 50,000 bottles per hour. The filling level checking system: the INNOCHECK FT 50 filling level checking system is available for checking the filling level of bottles and cans. Password-protected recording 20 different types of containers is part of the standard equipment as well as production statistics, counter readings for overfilling or underfilling, and diagnostic functions. The INNOCHECK FT 50 is easy to operate and features dependable filling level detection and a standardized link to reject systems. Crate checking: the INNOCHECK program offers various solutions for checking and detecting defective cartons, containers in cartons, shrink-wrap packaging, and plastic or metal closures. The simple and clearly arranged method of operation guarantees trouble-free machine performance for a multitude of applications.

Filling technology (INNOFILL) comprising: overpressure fillers—KHS offers several overpressure fillers: (INNOFILL EM, ER, EV, DR) equipped with mechanical and computer-controlled filling valves for filling carbonated beverages, particularly soft drinks and mineral water, in glass and plastic containers. A special feature of the INNOFILL EV is the volumetric recording of the filling volume using electromagnetic inductive flowmetering (MID) Capacities range from 5,000 to 80,000 bottles per hour, depending on the type of machine and the container to be filled. Normal pressure fillers: the KHS product program includes the INNOFILL NR double-chamber normal pressure bottle fillers. Equipped with computer-controlled filling valves, this filler is ideal for filling beverages in glass and plastic containers. The INNOFILL NR is capable of filling 6,000 to 70,000 0.07-liter bottles per hour. Can fillers: the INNOFILL product line for can filling is particularly suitable for filling beer, soft drinks, mixed beverages (carbonated and non-carbonated) as well as pulp and non-pulp juices (also hot filling). The complex filler program guarantees high performance standards and offers a host of engineering highlights, for instance, pressure-less filling of non-carbonated products. Or the extremely fast central filling level correction which can also be optionally used automatically during production operation. Particularly worthy of note are the filling temperatures; the approximate temperature for beer is 16 degrees Celsius, 20 degrees Celsius for soft drinks, and 85 degrees Celsius for juices. Rinsers: the KHS INNOFILL program includes two rinsers for single or double rinsing or blowing out of glass and plastic containers of various sizes and shapes. The EMZ/ZM rinser is a universal mechanical rinser with a capacity range from 10,000 to 75,000 bottles per hour. The universal computer-controlled triple-chamber DR rinser has the same capacity range. KMS offers the fully automatic DW can rinser designed for rinsing empty cans, which, depending on the configuration, is capable of outputs from 18,000 to 160,000 cans per hour.

Pasteurizing technology (INNOPAS): KHS pasteurizers are ideal for heating glass, plastic, and metal containers. Beverages and foods such as beer, vegetable juices, fruit juices, fruit juice drinks, and other products are thus biologically preserved. These machines operate fully automatically using the continuous flow processes to gradually heat, pasteurize, and re-cool the product to be pasteurized during the treatment period. Depending on the equipment installed, the pasteurizers are capable of outputs ranging from 10,000 to 200,000 containers per hour. Heaters: the INNOPAS W, equipped with a continuously running conveyor belt, is a fully automatic machine for warming up cold-filled beverages or food products. The heater's conveyor belt can be made of plastic for can and plastic bottle processing or stainless steel for glass bottle processing. Capacities range from 5,000 to 120,000 container per hour Re-coolers: the INNOPAS K, equipped with a continuously running conveyor belt, is a fully automatic machine for re-cooling hot-filled beverages or food products. Depending on their size, the re-coolers are designed as compact or segment-type machines. You may choose between plastic and stainless steel chain belts as a conveyor medium. Capacities range from 5,000 to 50,000 containers per hour.

Labelling technology (INNOKET): cold glue labeler—the INNOKET KL labeler is designed for cold glue processing of body, neck, back, neck ring, diagonal ribbon, and safety seal labels as well as aluminum foil. The product line is comprised of five different basic models which fulfill a host of customer capacity and equipment requirements through application-specific modular design (capacity range: 20,000 to 66,000 container per hour). The INNOKET KL can be optionally equipped with MIS, the Machine Information System. Hot-melt labelers: the INNOKET HL product line was developed especially for wrap-around labelling of glass and PET bottles, and cans. High-performance labelers for hot-melt processing. The gluing width is easily adapted to the various container material properties. Adhesives are gently treated by the "three-phase heat-up" (capacity range up to 45,000 per hour) Roll-fed labelers: the INNOKET RF is a high-performance labeler designed for processing paper or foil labels even as partial or wrap-around labels. The INNOKET RF offers dependable processing at capacities ranging up to 48,000 cans, glass or plastic bottles per hour, regardless if polypropylene, polyethylene, polystyrene or paper labels are used.

Packing technology (INNOPACK): robots: KHS builds folding arm or one column robots for the application in the packing and palletizing area. Four axes folding arm robots are used particularly, where low performance and high flexibility are in demand by changing position pictures or applications. Three-axes column robots are ideal by their high-dynamic servo-drives, if short cycle times, high pay load and high throughput rates are required. Cyclic packer: Two models of the fully automatic INNOPACK cyclic packer product line are available: CT and GT. Both are ideal for packing or unpacking bottles, jars, cans, multi packs in plastic crates, carton, or trays. The cyclic packer's extremely efficient operation achieves high packing performance while requiring a minimum amount of space (INNOPACK CT: 500 to 1,900 packagings per hour, INNOPACK GT: 1,000 to 7,000 module crates per hour). Two INNOPACK CT models are available: the short stroke machine (packing movement) for plastic crate processing and the long stroke version (Packing movement) for folding box processing. Multi-packer: the fully automatic operation of the INNOPACK GTM multipacker is used for combined packing of bulk containers in plastic crates and cartons or for placing multipacks in plastic crates, cartons, and trays. An outstanding feature of this machine is its horizontally moveable gripper traverse. Packing heads can be equipped as required with a gripping hook system, a vacuum gripping system, or a packing bell system, as well as a horizontally operating swivelling system. Rotary packer: the INNOPACK CR rotary packer is a continuously operating packing and unpacking machine designed for packing plastic crates or cartons (2,400 to 8,100 module crates per hour). It is capable of handling a multitude of tasks and its complex equipment maker it usable in all capacity ranges throughout the beverage industry. Two basic models of the rotary packer are available: size 1 for single and double-track crate conveyors, size 2 exclusively for double-track crate conveyors. Bottle aligner: KHS has developed a single and double-track, fully automatic INNOPACK FA series bottle alignment machine for integration in the packaging conveyor system for proper product presentation. The machine capacity is maximum 96,000 bottles per hour for a 6-second work cycle.

Palletizing technology (INNOPAL): palletizers: the INNOPAL palletizer concept is state-of-the-art and stands for high dependability, economy, and flexibility. Its modular design and versatility defined for customer advantage provide the ideal solution for each type of application. The INNOPAL PM and PL product lines offer machines and systems which can be equipped with a wide variety of loading heads. Nominal capacities range from 120 to 600 layers per hour depending on the model (single or double-column). Depalletizers: INNOPAL depalletizers are designed for the mid and upper capacity range. These machines depalletize by pushing jars, cans, glass or plastic bottles (also Petaloid-base bottles) even of various heights and diameters, layer by layer from pallets of the same size. Two models are available depending on the capacity and system configuration: the single-column, high-level packaging discharge INNOPAL AM with a capacity of 240 to 400 layers per hour and the double-column, low-level packaging discharge version of the INNOPAL AL with a capacity of up to 200 layers per hour. Crate stacker: the fully automatic plastic crate stackers of the INNOPAL KM product line are used as block buffer magazines if filling lines require buffer capacities exceeding 1,000 crates. They can be designed for a capacity of up to 10,000 crates. Pallet stackers: the fully automatic pallet stackers of the INNOPAL product line, stack or unstack pallets, kegs, crates, and with boxes to or from two or three-layers of pallets. Even various size pallets can be processed. Capacities range from 80 to 150 pallets per hour, depending on the model. Vertical pallet conveyors: the vertical pallet conveyors of the INNOPAL FM and FL product lines are fully automatic conveyor lines which link conveyor segments between floors or different levels. They are available in two models: INNOPAL FM. Single-column vertical conveyor ideal for conveying heights of up to 12 meters and loads of up to 1,000 kg. INNOPAL FL. Double-column, portal, vertical conveyor equipped with two lifting chains. The conveying height of the INNOPAL FL is up to 20 meters and the maximum load is 2,500 kg (two-space version).

Attendant equipment and systems such as plant information system (INNOLINE): the INNOLINE program includes conveyors designed for glass and PET bottles, and round, oval or rectangular shaped cans. In their capacity as linking elements between the processing stations, the container conveyors have a considerable effect on the function and efficiency of the overall system. For this reason, all models have the following distinguishing features; highly economical through the use of mechanical and electrical system of building blocks, optimum selection of materials, stable and sturdy design, easy to service through excellent accessibility, easy to clean, product-oriented conveyor regulation and controls, and low-pressure and low-noise conveying through SOFTSTEP MODULE. Pallet conveyors;: KHS offers a conveyor system comprised of standard elements capable of performing all the horizontal and vertical level movements necessary for in-feeding and discharging pallets. The building block type design permits coupling of all units in order to simply and clearly perform the most varied of conveying tasks. The INNOLINE program includes horizontal pallet conveyors (equipped with roller or chain conveyors), and vertically conveying pallet magazines, as well as pallet checking systems. Crate magazines: the INNOLINE KMZ is an empty crate row magazine. Available are single or double-track versions. The storage capacity depends on the length and the number of rows. The single-track version has a capacity for 280 to 570 module crates and the double-track version 560 to 1140 module crates. The fully automatic operation of the crate row magazines solve the problem of adequate buffer space between craters and decraters. In order to be able to optimize plant productivity, one should know exactly where the weak points are. This is the purpose and the job of the INNOLINE Plant information System (AIS). The AIS system, installed on a PC, handles the task of evaluating all production and disruption data collected, making it thus possible for plant operators to monitor the current status of the filling line at any time. All AIS information can also be integrated in other internal company DP systems.

All of the above website information is hereby incorporated by reference as if set forth in its entirety herein.

Examples of bottling systems, which may be used in embodiments of the present invention, may be found in the following U.S. patents, which are hereby incorporated by reference, as if set forth in their entirety herein include U.S. Pat No. 5,558,132 issued to Stock, et al. on Sep. 24, 1996 and entitled "Process and apparatus for cleaning container handling machines such as beverage can filling machines"; U.S. Pat. No. 5,634,500 issued to Clüsserath et al. on Jun. 3, 1997 and entitled "Method for bottling a liquid in bottles or similar containers"; and U.S. Pat. No. 5,713,403 issued to Cl üsserath et al. on Feb. 3, 1999 and entitled "Method and system for filling containers wirh a liquid filling product, and filling machine and labelling device for use with this method or system". All of the above U.S. patent documents in this paragraph are assigned to KRS Maschinen-und Anlagenbau Aktiengesellschaft of Dortmund, Federal Republic of Germany.

Examples of container labelling and/or filling machines and components thereof and/or accessories therefor may be found in the following documents, which are hereby incorporated by reference, as if set forth in their entirety herein include U.S. Pat. No. 4,911,285 issued to Rogall, et al. on Mar. 27, 1990 and entitled "Drive for a rotary plate in a labelling machine for bottles"; U.S. Pat. No. 4,944,830 issued to Zodrow et al. on Jul. 31, 1990 and entitled "Machine for labelling bottles"; U.S. Pat. No. 4,950,350 issued to Zodrow et al on Aug. 21, 1990 and entitled "Machine for labelling bottles or the like"; U.S. Pat. No 4,976,803 issued to Tomashauser et al. on Dec. 11, 1990 and entitled "Apparatus for pressing foil on containers, such as on the tops and the necks of bottles or the like"; U.S. Pat. No. 4,981,547 issued to Zodrow et al. on Jan. 1, 1991 and entitled "Mounting and drive coupling for the extracting element support of a labelling station for a labelling machine for containers and similar objects"; U.S. Pat No. 5,004,518 issued to Zodrow on Apr. 2, 1991 and entitled "Labelling machine for objects such as bottles or the like"; U.S. Pat. No. 5,017,261 issued to Zodrow et al. on May 21, 1991 and entitled "Labelling machine for objects such as bottles or the like"; U.S. Pat. No. 5,062,917 issued to Zodrow et al. on Nov. 5, 1991 and entitled "Support element for the followers of a cam drive of a drive mechanism and a labelling station equipped with a support element"; U.S. Pat. No. 5,062,918 issued to Zodrow on Nov. 5, 1991 and entitled "Glue segments which can be attachable to a drive shaft of a labelling machine"; U.S. Pat. No. 5,075,123 issued to Schwinghammer on Dec. 24, 1991 and entitled "Process and apparatus for removing alcohol from beverages"; U.S. Pat. No. 5,078,826 issued to Rogall on Jan. 7, 1992 and entitled "Labelling machine for the labelling of containers"; U.S. Pat. No. 5,087,317 issued to Rogall on Feb. 11, 1992 and entitled "Labelling machines for the labelling of containers; U.S. Pat. No. 5,110,402 issued Zodrow et al. on May 5, 1992 and entitled "Labelling machine for labelling containers such as bottles having a labelling box for a stack of labels in a labelling station"; U.S. Pat. No. 5,129,984 issued to Tomashauser et al an Jul. 14, 1992 and entitled "Machine for wrapping foil about the tops and necks of bottles"; U.S. Pat. No. 5,167,755 issued Zodrow et al. on Dec. 1, 1992 and entitled "Adhesive scraper which can be adjusted in relation to an adhesive roller in a labelling machine"; U.S. Pat. No. 5,174,851 issued Zodrow et al. on Dec. 29, 1992 and entitled "Labelling machine for labelling containers, such as bottles"; U.S. Pat. No. 5,185,053 issued to Tomashauser et al. on Feb. 9, 1993 and entitled "Brushing Station for a labelling machine for labelling bottles and the like"; U.S. Pat. No. 5,217,538 issued Buchholz et al. on Jun. 8, 1993 and entitled "Apparatus and related method for the removal of labels and foil tags adhering to containers, in particular, to bottles"; U.S. Pat. No. 5,227,005 issued to Zodrow et al. on Jul. 13, 1993 and entitled "Labelling station for labelling objects, such as bottles"; U.S. Pat. No. 5,413,153 issued to Zwilling et al. on May 9, 1995 and entitled "Container filling machine for filling open-top containers, and a filler valve therefore; and U.S. Pat. No. 5,569,353 issued to Zodrow on Oct. 29, 1996 and entitled "Labelling machine and apparatus for the automatic loading of the main magazine of a labelling machine, and a supply magazine which can be used in such an apparatus". All of the above U.S. patent documents in this paragraph are assigned to KHS Maschinen-und Anlagenbau Aktiengesellschaft of Dortmund, Federal Republic of Germany.

Some additional examples of container filling systems, valves or methods and their components which may be incorporated in an embodiment of the present invention may be found in U.S. Pat. No. 5,377,726 issued to Clüsserath on Jan. 3, 1995 and entitled "Arrangement for filling bottles or similar containers"; U.S. Pat. No. 5,402,833 issued to Cl üsserath on Apr. 4, 1995 and entitled "Apparatus for filling bottles or similar containers"; U.S. Pat. No. 5,425,402 issued to Pringle an Jun. 20, 1995 and entitled "Bottling system with mass filling and capping arrays"; U.S. Pat. No. 5,445, 194 issued to Clüsserath on Aug. 29, 1995 and entitled "Filling element for filling machines for dispensing a liquid filling material into containers"; and U.S. Pat. No. 5,450,882 issued to Gragun on Sep. 19, 1995 and entitled "Beverage dispensing apparatus and process", all of these U.S. patents being hereby expressly incorporated by reference.

Some further examples of container filling systems, valves or methods and their components which may possibly be incorporated into the present invention are to be found in U.S. Pat. No. 5,190,084 issued to Diehl et al. on Mar. 2, 1993 and entitled "Filling element for filling machines for dispensing liquid"; U.S. Pat. No. 5,195,331 issued to Zimmern et al. on Mar. 23, 1993 and entitled "Method of using a thermal expansion valve device, evaporator and flow control means assembly and refrigerating machined"; U.S. Pat. No. 5,209,274 issued to LaWarre, Sr. on May 11, 1993 and entitled "Filling valve apparatus having shortened vent tube"; U.S. Pat. No. 5,217,680 issued to Koshiishi et al. an Jun. 8, 1993 and entitled "Liquid filling method for a high-temperature and high-pressure vessel and apparatus therefor"; and U.S. Pat No. 5,241,996 issued to Werner et al. and entitled "Apparatus for filling liquid into containers", all of these U.S. patents being hereby expressly incorporated by reference.

Some yet further additional examples of container filling systems, apparatus or methods and their components which may possibly be incorporated into the present invention are to be found in U.S. Pat No. 3,960,066 issued to LaRocco et al. on Jun. 1, 1976 and entitled "Beverage preparation apparatus"; U.S. Pat. No. 4,103,721 issued to Noguchi on Aug. 1, 1978 and entitled "Method and apparatus for bottling beer"; U.S. Pat. No. 4,124,043 issued to Noguchi on Nov. 7, 1978 and entitled "Method and apparatus for bottling"; U.S. Pat. No. 4,135,699 issued to Petzsch et al. on Jan. 23, 1979 and entitled "Control valve for gaseous and liquid media"; U.S. Pat. No. 4,146,065 issued to Borstelmann on Mar. 27, 1979 and entitled "Method and machine for charging liquid into containers"; U.S. Pat. No. 4,171,714 issued to Knabe et al. on Oct. 23, 1979 and entitled "Filling machine for charging containers with a liquid"; U.S. Pat. No. 4,549,272 issued to Hagan et al. on Oct. 22, 1985 and entitled "Apparatus for filling containers with prescribed quantity of product by weight"; U.S. Pat. No. 4,599,239 issued to Wieland et al. on Jul. 8, 1986 and entitled "Method of preparing nonalcoholic beverages starting with a deaerated low sugar concentration base"; U.S. Pat. No. 5,058,632 issued to Lawarre, Sr. et al. on Oct. 22, 1991 and entitled "Filling valve apparatus"; U.S. Pat. No. 5,318,078 issued to Hantmann on Jun. 7, 1994 and entitled "Process for bottling beverages"; U.S. Pat. No. 5,365,771 issued to Gysi et al. and entitled "Process and apparatus for testing bottles for contamination"; U.S. Pat. No. 5,409,545 issued to Levey et al. on Apr. 25, 1995 and entitled "Apparatus and method for cleaning containers"; U.S. Pat. No. 5,458,166 issued to Kronseder on Oct. 17, 1995 and entitled "Cleansing system for a container treating machine"; U.S. Pat. No. 5,566,695 issued to Levey et al. and entitled "Modular apparatus and method for cleaning containers"; U.S. Pat. No. 5,689,932 issued to Peronek et al. on Nov. 25, 1997 and entitled "Quick change method and apparatus for filling and capping machines"; U.S. Pat. No. 5,732,528 issued to Peronek et al. and entitled "Container guide for filling and capping machine"; U.S. Pat. No. 5,778,633 issued to Sweeny on Jul. 14, 1998 and entitled "Quick change ledge support assembly for filling and capping machines"; and U.S. Pat. No. 6,058, 985 issued to Petri et al. on May 9, 2000 and entitled "Bottling machine with set-up table and a set-up table for a bottling machine and a set-up table for a bottle handling machine", all of these U.S. patents being hereby expressly incorporated by reference.

Some additional examples of methods and apparatuses for closing bottles and containers and their components which may possibly be incorporated in an embodiment of the presert invention may be found in U.S. Pat. No. 5,398,485 issued to Osifchin on Mar. 21, 1995 and entitled "Bottle support mechanism for a capping machine"; U.S. Pat. No. 5,402,623 issued to Ahlers on Apr. 4, 1995 and entitled "Method and apparatus for closing bottles"; U.S. Pat. No. 5,419,094 issued to Vander Bush, Jr. et al. on May 30, 1995 and entitled "Constant speed spindles for rotary capping machine"; U.S. Pat. No. 5,425,402 issued to Pringle on Jun. 20, 1995 and entitled "Bottling system with mass filling and capping arrays"; U.S. Pat. No. 5,447,246 issued to Finke on Sep. 5, 1995 and entitled "Methods and combinations for sealing corked bottles"; U.S. Pat. No. 5,449,080 issued to Finke on Sep. 12, 1995 and entitled "Methods and combinations for sealing corked bottles"; and U.S. Pat. No. 5,473,855 issued to Hidding et al. and entitled "System for installing closures on containers", all of these U.S. patents being hereby expressly incorporated by reference.

Some further examples of methods and apparatuses for filling containers and their components which may possibly be incorporated in an embodiment of the present invention may be found in U.S. Pat. No. 3,946,770 issued to Trinne et al. on Mar. 30, 1976 and entitled "Bottle filling means and method"; U.S. Pat. No. 4,136,719 issued to Kronseder et al. on Jan. 30, 1979 and entitled "Method and device for cleaning bottle filling machines and the like"; U.S. Pat. No. 4,446,673 issued to Desthieux on May 8, 1984 and entitled "Bottle-filling method and device"; U.S. Pat. No. 4,467,846 issued to Croser on Aug. 28, 1984 and entitled "Bottle filling device"; U.S. Pat. No. 4,653,249 issued to Simonazzi on Mar. 31, 1987 and entitled "Telescopic filling adapter for bottle filling machines"; U.S. Pat. No. 4,911,21 issued to Burton on Mar. 27, 1990 and entitled "Bottle filling device"; U.S. Pat. No. 4,967,813 issued to Ponvianne et al. on Nov. 6, 1990 and entitled "Bottle filling machine and filling head therefor"; U.S. Pat. No. 4,987,726 issued to Pethö et al. on Jan. 29, 1991 and entitled "Bottle filling and sealing apparatus"; U.S. Pat. No. 5,191,742 issued to Jones on Mar. 9, 1993 and entitled AFuidized bed bottle filling system"; U.S. Pat. No. 5,454,421 issued to Kerger et al, on Oct. 3, 1995 and entitled "Device for filling and emptying a gas bottle"; U.S. Pat. No. 5,494,086 issued to McBrady et al. on Feb. 27, 1996 and entitled "Bottle filling machine"; U.S. Pat. No. 5,533,552 issued to Ahlers on Jul. 9, 1996 and entitled "Bottle filling machine and a cleansing system accessory including an operator therefor"; and U.S. Pat. No. 5,582,223 issued to Weh et al. on Dec. 10, 1996 and entitled "Filling apparatus for gas bottle valves", all of these U.S. patents being hereby expressly incorporated by reference.

Examples of rotary position sensors and rotary position indicators, components thereof, and components associated therewith, which may be utilized in accordance with the embodiments of the present invention, may be found in the following U.S. patents: U.S. Pat. No 4,360,889 issued to Liedtke on Nov. 23, 1982 and entitled "Rotary position indicating circuit"; U.S. Pat. No. 4,458,893 issued to Ruh on Jul. 10, 1984 and entitled "Drive for sheet feeder in printing press"; U.S. Pat. No. 4,581,993 issued to Schöneberger on Apr. 15, 1986 and entitled "Device for a printing press comprising a plate cylinder and/or blanket cylinder"; U.S. Pat. No. 4,841,246 issued to Juds et al. on Jun. 20, 1989 and entitled "Multiturn shaft position sensor having magnet movable with nonrotating linear moving unit"; U.S. Pat. No. 4,899,643 issued to Hvilsted et al. on Feb. 13, 1990 and entitled "Hydraulic cylinder comprising at least one electric position indicator"; U.S. Pat. No. 5,222,457 issued to Friedrich on Jun. 6, 1993 and entitled "indicator for rotary positioner"; U.S. Pat. No. 5,396,139 issued to Surmely et al. on Mar. 7, 1995 and entitled "Polyphase electromagnetic transducer having a multipolar permanent magnet"; U.S. Pat. No. 5,419,195 to Quinn on May 30, 1995 and entitled "Ultrasonic booted head probe for motor bore inspection"; U.S. Pat. No. 5,424,632 issued to Montagu on Jun. 13, 1995 and entitled "Moving magnet optical scanner with novel rotor design"; U.S. Pat. No. 5,433,118 issued to Castillo on Jul. 18, 1995 and entitled "Magnetic turbine rotor for low flow fluid meter"; U.S. Pat. No. 5,442,329 issued to Ghosh et al. on Aug. 15, 1995 and entitled "Waveguide rotary joint and mode transducer structure therefor"; and U.S. Pat. No. 5,444,368 issued to Horber on Aug. 22, 1995 and entitled "Differential reactance permanent magnet position transducer", all of these U.S. patents being hereby expressly incorporated by reference.

Examples of filling machines that utilize electronic control devices to control various portions of a filling or bottling process and which may possibly be utilized in connection with the present invention are to be found in U.S. Pat. No. 4,821,921 issued to Cartwright et al. on Apr. 18, 1989 and entitled "Liquid dispensing apparatus"; U.S. Pat. No. 5,056,511 issued to Ronge on Oct. 15, 1991 and entitled "Method and apparatus for compressing, atomizing, and spraying liquid substances"; U.S. Pat. No. 5,273,082 issued to Paasche et al. on May 27, 1992 and entitled "Method and apparatus for filling containers"; and U.S. Pat No. 5,301,488 issued to Ruhl et al. on Nov. 6, 1992 and entitled "Programmable filling and capping machine", all of these U. S patents being hereby expressly incorporated by reference herein.

Rotary mechanical devices relating to bottling are to be found in U.S. Pat. No. 4,976,803 issued to Tomashauser et al. on Dec. 11, 1990 and entitled "Apparatus for pressing foil on containers, such as on the tops and the necks of bottles or the like", also referred to above; U.S. Pat. No. 5,087,317 issued to Rogall on Feb. 11, 1992 and entitled "Labelling machine for the labelling of containers", also referred to above; U.S. Pat No. 5,174,851 issued to Zodrow et al. on Dec. 29, 1992 and entitled Labelling machine for labelling containers, such as bottles", also referred to above; U.S. Pat. No. 5,185,053 issued to Tomashauser et al. on Feb. 9, 1993 and entitled "Brushing station for a labelling machine for labelling bottles and the like", also referred to above; U.S. Pat. No. 5,217,538 issued to Buchholz et al. on Jun. 8, 1993 and entitled "Apparatus and related method for the removal of labels and foil tags adhering to containers, in particular, to bottles", also referred to above; and U.S. Pat. No. 5,219,405 issued to Weiss on Jun. 15, 1993 and entitled "Continuously operating rotational bottle filling installation", and all of these U.S. patents being hereby expressly incorporated by reference herein.

Examples of capping devices which may possibly be incorporated into the present invention are to be found in U.S. Pat. No. 4,939,890 issued to Peronek et al. on Apr. 14, 1989 and entitled "Anti-rotation method and apparatus for bottle capping machines"; U.S. Pat. No. 5,150,558 issued to Bernhard on Jul. 5, 1991 and entitled "Closing mechanism for a capping machine"; U.S. Pat. No. 5,157,897 issued to McKee et al. on Oct. 27, 1992 and entitled "Rotary capping machine"; and U.S. Pat. No. 5,220,767 issued to de Santana on Jun. 22, 1993 and entitled "Device for applying a cap and seal to the mouth of a bottle whereon an interference boss is provided for said seal", all of these U.S. patents being hereby expressly incorporated by reference herein. An example of an electric probe utilized in connection with a bottle filling process which may be incorporated into the present invention is to be found in U.S. Pat. No. 5,190,084 issued to Diehl et al. on May 3, 1991 and entitled "Filling element for filling machines for dispensing liquid", which U.S. patent is hereby expressly incorporated by reference herein.

Other examples of liquid level probes which may be incorporated into the present invention are to be found in U.S. Pat. No. 4,903,530 issued to Hull on Dec. 8, 1988 and entitled "Liquid level sensing system"; U.S. Pat. No 4,908,783 issued to Maier on Apr. 28, 1987 and entitled "Apparatus and method for determining liquid levels"; and U.S. Pat. No. 4,921,129 issued on Jul. 11, 1988 to Jones et al. and entitled "Liquid dispensing module", all of these U.S. patents being hereby expressly incorporated by reference herein.

Some example computer systems and methods and their components which may possibly be incorporated in an embodiment of the present invention are to be found in U.S. Pat. No. 5,379,428 issued to Belo on Jan. 3, 1995 and entitled "Hardware process scheduler and processor interrupter for parallel processing computer systems"; U.S. Pat.

No. 5,390,301 issued to Scherf on Feb. 14, 1995 and entitled "Method and apparatus for communicating device-specific information between a device driver and an operating system in a computer system"; U.S. Pat. No. 5,398,333 issued to Schieve et al. on Mar. 14, 1995 and entitled "Personal computer employing reset button to enter ROM-based diagnostics"; U.S. Pat. No. 5,404,544 issued to Crayford on Apr. 4, 1995 and entitled "System for periodically transmitting signal to/from sleeping node identifying its existence to a network and awakening the sleeping node responding to received instruction"; U.S. Pat. No. 5,418,942 issued to Krawchuk et al. on May 23, 1995 and entitled "System and method for storing and managing information"; U.S. Pat. No. 5,428,790 issued to Harper et al. on Jun. 27, 1995 and entitled "Computer power management system"; and U.S. Pat. No. 5,479,355 issued to Hyduke on Dec. 26, 1995 and entitled "System and method for a closed loop operation of schematic designs with electrical hardware", all of these U.S. patents being hereby expressly incorporated by reference herein.

Some examples of switches or levers, or components thereof, which may possibly be incorporated in an embodiment of the present invention are to be found in U.S. Pat. No. 5,392,895 issued to Sörensen on Feb. 28, 1995 and entitled "Transfer unit"; U.S. Pat. No. 5,404,992 issued to Robu et al. on Apr. 11, 1995 and entitled "Suspension conveyor system"; U.S. Pat. No. 5,438,911 issued to Fiedler et al. on Aug. 8, 1995 and entitled "Control cylinder for pneumatic control devices with signal switches"; U.S. Pat. No. 5,440,289 issued to Riordan on Aug. 8, 1995 and entitled "Combined alarm system and window covering assembly"; and U.S. Pat. No. 5,462,245 issued to Durchachlag and entitled "Apparatus for locking moveable switch parts", all of these U.S. patents being hereby expressly incorporated by reference herein.

Some examples of sensors and switches which may possibly be incorporated in an embodiment of the invention are to be found in U.S. Pat. No. 5,378,865 issued to Reneau on Jan. 3, 1995 and entitled "Multi-directional shock sensor"; U.S. Pat. No. 5,379,023 issued to Dalton on Jan. 3, 1995 and entitled "Alarm system"; U.S. Pat. No. 5,408,132 issued to Fericeau et al. on Apr. 18, 1995 and entitled "Proximity switch operating in a non-contacting manner"; U.S. Pat. No. 5,428,253 issued to Ogata et al. on Jun. 27, 1995 and entitled "Proximity switch"; U.S. Pat. No. 5,430,421 issued to Bornand et al on Jul. 4, 1995 and entitled "Reed contactor and process of fabricating suspended tridimensional metallic microstructure"; U.S. Pat. No. 5,442,150 issued to Ipcinski on Aug. 15, 1995 and entitled "Piezo electric switch"; U.S. Pat. No. 5,444,295 issued to Lake et al. on Aug. 22, 1995 and entitled "Linear dual switch module"; U.S. Pat. No. 5,453,589 issued to Mayer on Sep. 26, 1995 and entitled "Microswitch with non-enlarging, sealed electrical connections"; and U.S. Pat. No. 5,453,590 issued to Mayer on Sep. 26, 1995 and entitled "Bistable microswitch", all of these U.S. patents being hereby expressly incorporated by reference herein.

Some examples of pressure sensors which may possibly be incorporated in an embodiment of the present invention are to be found in U.S. Pat. No. 4,703,657 issued to Hirama et al, on Nov. 3, 1987 and entitled "Gas pressure sensor"; U.S. Pat. No. 4,812,801 issued to Halvis et al. on Mar. 14, 1989 and entitled "Solid state gas pressure sensor"; U.S. Pat. No. 5,597,020 issued to Miller et al. on Jan. 28, 1997 and entitled "Method and apparatus for dispensing natural gas with pressure calibration", U.S. Pat. No. 5,763,762 issued to Sweeney, Jr. on Jun. 9, 1998 and entitled "Total dissolved gas pressure sensor, replaceable collector module and process"; and U.S. Pat. No. 5,925,823 issued to Buehler et al. on Jul. 20 1999 and entitled "Alpha-particle gas-pressure sensor", all of these U.S. patents being hereby expressly incorporated by reference herein.

Some further examples of microcomputer control systems which may possibly be incorporated in an embodiment of the present invention are to be found in U.S. Pat. No. 5,530,515 issued to Saegusa et al. on Jun. 25, 1996 and entitled "Control system for an apparatus using a microprocessor"; U.S. Pat. No. 5,548,774 issued to Maurel on Aug. 20, 1996 and entitled "Microcomputer system providing time management enabling control and acquisition of data indicative of condition changes occurring at high speed"; U.S. Pat. No. 5,581,771 issued to Osakabe on Dec. 3, 1996 and entitled "Microcomputer having interrupt control circuit to determine priority level"; U.S. Pat. No. 5,610,749 issued to Mizoguchi et al. on Mar. 11, 1997 and entitled "Microcomputer control optical fiber transmission systems; U.S. Pat. No. 5,619,669 issued to Katsuta on Apr. 8, 1997 and entitled "Memory wait cycle control system for microcomputer"; U.S. Pat. No. 5,664,199 issued to Kuwahara on Sep. 2, 1997 and entitled "Microcomputer free from control of central processing unit (CPU) for receiving and writing instructions into memory independent of and during execution of CPU"; and U.S. Pat. No. 5,687,345 issued to Matsubara et al. on Nov. 11, 1997 and entitled "Microcomputer having CPU and built-in flash memory that is rewriteable under control of the CPU analyzing a command supplied from an external device", all of these U.S. patents being hereby expressly incorporated by reference herein.

Some further examples of microprocessor control systems which may possibly be incorporated in an embodiment of the present invention may be found in U.S. Pat. No. 4,202,035 issued to Lane on May 6, 1980 and entitled "Modulo addressing apparatus for use in a microprocessor"; U.S. Pat. No. 4,307,448 issued to Sattler on Dec. 22, 1981 and entitled "Method and a circuit arrangement for expanding the addressing capacity of a central unit, in particular of a microprocessor"; U.S. Pat. No. 4,419,727 issued to Holtey et al. on Dec. 6, 1983 and entitled "Hardware for extending microprocessor addressing capability"; U.S. Pat. No. 5,541,045 issued to Kromer, III on Sep. 10, 1985 and entitled "Microprocessor architecture employing efficient operand and instruction addressing"; U.S. Pat. No. 5,293,062 issued to Nakao on Mar. 8, 1994 and entitled FET nonvolatile memory with composite gate insulating layer"; U.S. Pat. No. 5,292,681 issued to Lee et al. on Mar. 8, 1994 and entitled "Method of processing a semiconductor wafer to form an array of nonvolatile memory devices employing floating gate transistors and peripheral area having CMOS transistors"; and U.S. Pat. No. 5,301,161 issued to Landgraf et al on Apr. 5, 1994 and entitled "Circuitry for power supply voltage detection and system lockout for a nonvolatile memory", all of these U.S. patents being hereby expressly incorporated by reference herein.

The details in the patents, patent applications and publications may be considered to be incorporable, at applicants' option, into the claims during prosecution as further limitations in the claims to patentably distinguish any amended claims from any applied prior art.

Some further examples of bottling systems and features, which may possibly be used in embodiments of the present invention, which are incorporated by reference, as if set forth in their entirety herein, are to be found in U.S. patent application Ser. No. 08/238,613 filed on May 5, 1994 entitled "Apparatus for sorting bottles or similar containers", having inventors Christoph WEISSENFELS and Manfred LONNIG, which corresponds to Federal Republic of Germany patent application No. P 43 15 038, filed May 6, 1993, which corresponds to DE-OS 43 15 038 and DE-PS 43 15 038; U.S. patent application Ser. No. 08/246,605 filed on May 20, 1994 entitled "Method and arrangement for converting a single-row stream of containers into a multi-row stream of containers", having inventor Heinz-Jürgen SCHERER, which corresponds to Federal Republic of Germany patent application No. P 43 17 069 filed on May 21, 1993, which corresponds to DE-OS 43 17 069 and DE-PS 43 17 069; U.S. patent application Ser. No. 08/372,674 filed on Jan. 16, 1995 entitled "Apparatus for processing containers returned to food and beverage producers for the refilling of the containers", having inventor Karl HEIDRICH, which corresponds to Federal Republic of Germany patent application No. P 42 23 427 filed on Jul. 16, 1992, which corresponds to DE-OS 42 23 427 and DE-PS 42 23 427, and International application No. PCT/DE93/00586 filed on Jul. 1, 1993, which corresponds to WO 94/02848; U.S. patent application Ser. No. 08/383,156 filed on Feb. 3, 1995 entitled "Apparatus for processing containers returned to food and beverage producers for the refilling of the containers", having inventors Rüdiger STRAUCHMANN Marten PETERS, and Hubert GAISEAUER, which corresponds to Federal Republic of Germany patent application No. P 42 25 984 filed on Aug. 6, 1992, which corresponds to DE-OS 42 25 984 and DE-PS 42 25 984, and International application No. PCT/DE93/00692 filed Aug. 4, 1993, which corresponds to WO 94/03287; all of the above U.S. patent documents in this paragraph are assigned to KHS Maschinen-und Anlagenbau Aktiengesellschaft of Dortmund, Federal Republic of Germany.

U.S. patent application Ser. No. 09/282,975 38,613 filed on Mar. 31, 1999, having the inventor Herbert BERNHARD, with and claiming priority from Federal Republic of Germany Patent Application No. 198 14 625.6 which was filed on Apr. 1, 1998, and DE-OS 198 14 625.6 and DE-PS 198 14 625.6 are hereby incorporated by reference as it set forth in their entirety herein.

U.S. patent application Ser. No. 09/299,497 filed on Apr. 26, 1999, having the inventor Ludwig CLÜSSERATH, with and claiming priority from Federal Republic of Germany Patent Application No. 198 18 761.0 which was filed on Apr. 27, 1998, and DE-OS 198 18 761.0 and DE-PS 198 18 761.0, are hereby incorporated by reference as if set forth in their entirety herein.

U.S. patent application Ser. No. 09/300,015 filed on Apr. 27, 1999, having the inventor Ludwig CLÜSSERATH, with and claiming priority from Federal Republic of Germany Patent Application No. 198 18 762.9 which was filed on Apr. 27, 1998, and DE-OS 198 18 762.9 and DE-PS 198 18 762.9, are hereby incorporated by reference as if set forth in their entirety herein.

U.S. patent application Ser. No. 09/373,132 filed on Aug. 12, 1999, having the inventor Ludwig CLÜSSERATH, with and claiming priority from Federal Republic of Germany Patent Application No. 198 36 500 which was filed on Apr. Aug. 12, 1998, and DE-OS 198 36 500 and DE-PS 198 36 500, are hereby incorporated by reference as if set forth in their entirety herein.

This invention as described hereinabove in the context of the preferred embodiments is not to be taken as limited to all of the provided details thereof, since modifications and variations thereof may be made without departing from the spirit and scope of the invention.

AT LEAST PARTIAL NOMENCLATURE

For FIG. 1

101 Rinser
102 Bottle
103 Conveyor line
104 Conveyor line
105 Filling machine
105' Rotor
106 Closer
107 Conveyor line
108 Labelling device
109 Conveyor
111 Conveyor
112 Central controller
113 Filling position
114 Filling element
117 Toroidal vessel
121 Conduit
122 Conduit
123 First product mixer
124 Second product mixer
A1 arrow of direction of conveyor 103

For FIGS. 2 to 5

1 Filling machine
2 Bottle
3 Rotor
4 Filling element
5 Container carrier
6 Conveyor
7 Bottle input or loading portion
8 Bottle output or unloading portion
9 Filling element housing
10 Fluid channel
11 Fluid valve
12 Ring boiler
13 Filling material portion
14 Gas space
15 Conduit
16 Injection or tensioning gas conduit
17 Injection or tensioning gas annulus channel
18 Connecting conduit
19 First return gas annulus channel
20 Second return gas annulus channel
21 Vacuum annulus channel
22 Return gas conduit
23 Gas channel
24 Control valve device
25 Pressure sensor
26 Computer-assisted supervisory electronic unit or computer/controller
26' Memory
27 Ramp profile line or curve
27' upper narrow range
27" lower narrow range
27'" upper wide range
27"" lower wide range
30 Stored program control
31*a* & *b* Control valve
32 Control valve
33*a* & *b* Control valve

34 Control valve
35 Level sensor/control device
A Direction of motion of rotor 3
N Level in filling material portion 13

For FIG. 6

Figure 7:
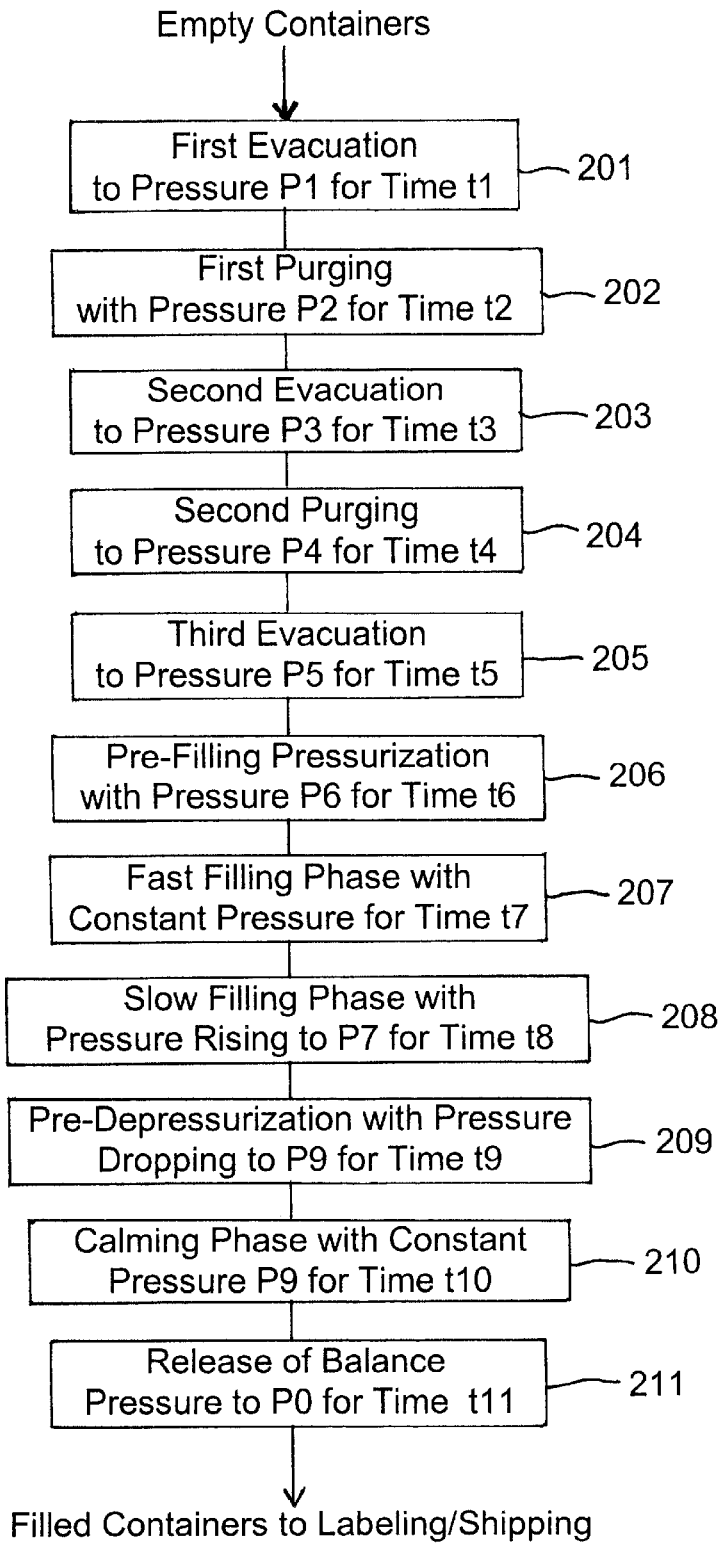
FIG. 7 is a block flow diagram showing schematically steps of a filling method.

1 Filling machine
4 Filling element
25 Pressure sensor
26 Controller
26' Storage arrangement
150 Beverage type selector apparatus
151 Gas ($CO_2$) supply apparatus
152 Temperature control apparatus
153 Volume control apparatus
154 Filling height control apparatus
155 Filling method selector apparatus
156 Verification apparatus for 150
157 Sensor for 151
158 Sensor for 152
159 Sensor for 153
160 Sensor for 154
161 Method corrector apparatus
162 Control apparatus
163 Closing apparatus
164 Labelling apparatus
165 Vacuum control apparatus
166 Washing apparatus
167 Packing or containerization apparatus For FIGS. 7 and 8

201 First evacuation
202 First purging/washing
203 Second evacuation
204 Second purging or washing
205 Third evacuation
206 Pre-filling pressurization
207 Fast filling phase
208 Slow filling phase
209 Pre-depressurization
210 Claiming phase
211 Balance pressure release
220 Washing apparatus
221 Filling apparatus
222 Filling level checking apparatus
223 Capping or closing apparatus
224 Labelling apparatus
225 Inspection apparatus
226 Packing apparatus

What is claimed is:

1. A filling machine for filling beverage containers, said beverage containers comprising bottles or cans, with a liquid in a container filling process, said filling machine comprising:

a plurality of filling positions;

each filling position having a filling element to fill a corresponding container with liquid;

apparatus to move empty containers to a filling element;

each filling element being configured and disposed to receive a corresponding container to be filled from said apparatus to move empty containers;

apparatus to remove a filled container from a filling element;

apparatus to hold a container to be filled in sealing attitude at a filling element;

each filling element having a portion to introduce at least one process pressure into the interior space of a corresponding container;

at least one pressure sensor;

each sensor being disposed and configured to sense a pressure, during filling of a corresponding container with liquid, related to the interior of a corresponding container sealingly connected with the corresponding filling element;

each sensor being configured to produce at least one indication representative of a pressure sensed, during filling of a corresponding container with liquid, related to the interior of a corresponding container;

a controller;

said controller being configured to receive from a corresponding sensor said at least one indication representative of a pressure sensed, during filling of a corresponding container with liquid, related to the interior of a corresponding container; and apparatus configured to control at least one process parameter related to filling a container in the filling machine;

said controller being further configured to control said control apparatus for said at least one process parameter of said filling machine.

2. The filling machine in accordance with claim 1 wherein:

said controller is common to all filling elements;

each pressure sensor produces an electrical signal representative of a sensed pressure, and said controller comprises an electronic control system which is common to all filling elements; and said filling machine further comprises apparatus to pass a corresponding electrical signal representative of a sensed pressure to said common electronic control system.

3. The filling machine according to claim 2 wherein said at least one pressure sensor is configured to sense, on an individual basis, a pressure behavior of each filling element in conformity with time during filling of a corresponding container and wherein said controller is configured to compare an actual pressure behavior with a set point pressure behavior.

4. The filling machine according to claim 3 wherein said controller includes a storage arrangement; said storage arrangement being configured to store a representation of a set point pressure specific to filling liquid and wherein said controller is configured to compare a prevailing actual pressure with an associated set point pressure which is resulting from a corresponding set point pressure behavior.

5. A filling machine for filling beverage containers, said beverage containers comprising bottles or cans, with a liquid in a container filling process, said filling machine comprising:

apparatus to fill said containers with liquid;

apparatus to move empty containers to said filling apparatus;

apparatus to remove filled containers from said filling apparatus;

each filling apparatus comprising at least one pressure sensor;

said at least one pressure sensor being configured and disposed to sense at least one pressure condition, during filling of a corresponding container with liquid, related to the interior space of a corresponding container that is connected with said filling apparatus and said sensor being configured to generate at least one indication representative of an at least one pressure condition sensed during filling of a corresponding container with liquid;

a controller;

said controller being configured to receive said at least one indication representative of an at least one pressure condition sensed during filling of a corresponding container with liquid; and apparatus to control at least one process parameter related to filling a container in the filling machine;

said apparatus to control at least one process parameter being configured to receive process control functions under instructions from said controller based on said at least one indication representative of an at least one pressure condition sensed, during filling of a corresponding container with liquid, related to the interior space of a corresponding container.

6. The filling machine according to claim 5 and further comprising:

apparatus to provide a set point value; and apparatus to provide a first tolerance limit;

wherein said controller is configured to provide, in an event of a difference, between an actual pressure sensed by said at least one sensor and a set point value provided by said apparatus to provide a set point value, that exceeds a first tolerance limit provided by said apparatus to provide a first tolerance limit, at least one error signal which comprises at least one identification of the corresponding filling apparatus.

7. The filling machine according to claim 6 and further comprising:

apparatus to provide a second tolerance limit;

wherein said controller is configured to initiate, in an event of a difference, between an actual value sensed by said at least one sensor and a set point value provided by said apparatus to provide a set point value, which exceeds a pre-set second tolerance limit provided by said apparatus to provide a second tolerance limit, at least one error signal which includes an identification of the corresponding filling apparatus and which causes a shutting-off of the filling machine and/or a removal of a corresponding container at the corresponding filling apparatus.

8. The filling machine according to claim 7 wherein said controller is configured to initiate, in an event of a difference, between a set point value and an actual value that is being determined at a filling apparatus, a difference signal for correcting the corresponding process step, particularly for correcting the duration of the process step.

9. The filling machine according to claim 8 wherein said controller includes a storage arrangement configured to store a corresponding set point value, as well as said first and second tolerance limits, in a manner specific to varying filling materials, for the at least one corresponding process step.

10. The filling machine according to claim 9 wherein said storage arrangement is configured to store, for filling processes with a plurality of process steps, the entire desired pressure behavior as steady state characteristic, and together with associated tolerance limits.

11. The filling machine according to claim 10 which comprises a revolving structure having a rotor that rotates about a vertical machine axis and wherein said filling apparatus comprises at least one filling element disposed at the circumference of said rotor that rotates about said vertical machine axis.

12. The filling machine according to claim 11 wherein said controller is configured to initiate a corresponding set point value, or, respectively, a corresponding set point pressure behavior for each filling portion and said controller is configured to initially produce, from signals produced by said at least one pressure sensor, a steady state characteristic, by averaging of the pressure signals which the various pressure sensors deliver from said filling elements in conformity with their corresponding process steps.

13. The filling machine according to claim 12 wherein said controller is configured to determine, under consideration of data specific to filling material and/or container, as well as under consideration of parameters stored in said storage arrangement, in beverage and container dependent manner, a set point pressure behavior and said controller is configured to initiate, based on a corresponding comparison, between a set point pressure behavior and an actual pressure behavior, a signal for correcting the filling process, or to generate an error message.

14. The filling machine according to claim 13 wherein said at least one pressure sensor of each filling element is disposed at a gas channel formed in said filling element, said gas channel being in communication with the interior space of a corresponding container positioned at a corresponding filling element.

15. The filling machine according to claim 14 wherein said gas channel in which a corresponding pressure sensor is disposed, comprises that return gas channel that is connected with a corresponding return gas conduit of a corresponding filling element.

16. The filling machine according to claim 5 wherein said controller comprises computing apparatus operating under instructions of digital data processing.

17. The filling machine according to claim 16 wherein each pressure sensor produces an electrical signal representative of a sensed pressure, and said controller comprises an electronic control system which is common to all filling elements; and further comprising:

apparatus to pass a corresponding electrical signal representative of a sensed pressure to said common electronic control system.

18. The filling machine according to claim 16 wherein said computing apparatus comprises a computer-assisted electronic control system.

19. The filling machine according to claim 5 which comprises at least one of (A) through (P):

(A) said controller is common to all filling elements;

(B) said at least one pressure sensor is configured to sense, on in individual basis, a pressure behavior of each filling element in conformity with time during filling of a corresponding container and wherein said controller is configured to compare an actual pressure behavior with a set point pressure behavior;

(C) said controller includes a storage arrangement; said storage arrangement being configured to store a presentation of a set point pressure specific to filling material and wherein said controller is configured to compare a prevailing actual pressure with an associated set point pressure which is resulting from a corresponding set point pressure behavior;

(D) apparatus to provide a set point value;

(E) apparatus to provide a first tolerance limit; wherein said controller is configured to provide, in an event of a difference, between an actual pressure sensed by said at least one sensor and a set point value provided by said apparatus to provide a set point value, that exceeds a first tolerance limit provided by said apparatus to provide a first tolerance limit, at least one error signal which comprises at least one identification of the corresponding filling apparatus;

(F) apparatus to provide a second tolerance limit; wherein said controller is configured to initiate, in an event of a difference, between an actual value sensed by said at least one sensor and a set point value provided by said apparatus to provide a set point value, which exceeds a pre-set second tolerance limit provided by said apparatus to provide a second tolerance limit, at least one error signal which includes the identification of the corresponding filling apparatus and which causes a shutting-off of the filling machine and/or a removal of a corresponding container at the corresponding filling apparatus;

(G) said controller is configured to initiate, in an event of a difference, between a set point value and an actual value that is being determined at a filling apparatus, a difference signal for correcting the corresponding process step, for correcting the duration of the process step;

(H) said controller includes a storage arrangement configured to store a corresponding set point value, as well as said first and second tolerance limits, in a manner specific to varying filling materials, for the at least one corresponding process step;

(I) said storage arrangement is configured to store, for filling processes with a plurality of process steps, the entire desired pressure behavior as steady state characteristic, together with the associated tolerance limits;

(J) a revolving structure having a rotor that rotates about a vertical machine axis and wherein said apparatus comprises at least one filling element disposed at the circumference of said rotor that rotates about said vertical machine axis;

(K) said controller is configured to initiate a corresponding set point value, or, respectively, a corresponding set point pressure behavior for each filling portion and said controller is configured to initially produce, from signals produced by said at least one pressure sensor, a steady state characteristic, by averaging of the pressure signals which the various pressure sensors deliver from said filling elements in conformity with their corresponding process steps;

(L) said controller is configured to determine, under consideration of data specific to filling material and/or container, as well as under consideration of parameters stored in said storage arrangement, in beverage and container dependent manner, a set point pressure behavior and said controller is configured to initiate, based on a corresponding comparison, between a set point pressure behavior and an actual pressure behavior, a signal for correcting the filling process, or to generate an error message;

(M) said at least one pressure sensor of each filling element is disposed at a gas channel formed in said filling element, said gas channel being in communication with the interior space of a corresponding container positioned at a corresponding filling element;

(N) said gas channel in which a corresponding pressure sensor is disposed, comprises that return gas channel that is connected with a corresponding return gas conduit of a corresponding filling element;

(O) said controller comprises computing apparatus operating under instructions of digital data processing; and (P) each pressure sensor produces an electrical signal representative of a sensed pressure, and said controller comprises an electronic control system which is common to all filling elements.

20. The filling machine according to claim 5 which comprises in combination (A) through (P):

(A) said controller is common to all filling elements;

(B) said at least one pressure sensor is configured to sense, on an individual basis, a pressure behavior of each filing element in conformity with time during filling of a corresponding container and wherein said controller is configured to compare an actual pressure behavior with a set point pressure behavior;

(C) said controller includes a storage arrangement; said storage arrangement being configured to store a representation of a set point pressure specific to a filling material and wherein said controller is configured to compare a prevailing actual pressure with an associated set point pressure which is resulting from a corresponding set point pressure behavior;

(D) apparatus to provide a set point value;

(E) apparatus to provide a first tolerance limit; wherein said controller is configured to provide, in an event of a difference, between an actual pressure sensed by said at least one sensor and a set point value provided by said apparatus to provide a set point value, that exceeds a first tolerance limit provided by said apparatus to provide a first tolerance limit, at least one error signal which comprises at least one identification of the corresponding filling apparatus;

(F) apparatus to provide a second tolerance limit; wherein said controller is configured to initiate, in an event of a difference, between an actual value sensed by said at least one sensor and a set point value provided by said apparatus to provide a set point value, which exceeds a pre-set second tolerance limit provided by said apparatus to provide a second tolerance limit, at least one error signal which includes the identification of the corresponding filling apparatus and which causes a shutting-off of the filling machine and/or a removal of a corresponding container at the corresponding filling apparatus;

(G) said controller is configured to initiate, in an event of a difference, between a set point value and an actual value that is being determined at a filling apparatus, a difference signal for correcting the corresponding process step; particularly for correcting the duration of the process step;

(H) said controller includes a storage arrangement configured to store a corresponding set point value, as well as said first and second tolerance limits, in a manner specific to varying filling materials, for the at least one corresponding process step;

(I) said storage arrangement is configured to store, for filling processes with a plurality of process steps, the entire desired pressure behavior as steady state characteristic, together with the associated tolerance limits;

(J) a revolving structure having a rotor that rotates about a vertical machine axis and wherein said filling apparatus comprises at least one filling element disposed at the circumference of said rotor that rotates about said vertical machine axis;

(K) said controller is configured to initiate a corresponding set point value, or, respectively, a corresponding set point pressure behavior for each filling portion and said controller is configured to initially produce, from signals produced by said at least one pressure sensor, a steady state characteristic, by averaging of the pressure signals which the various pressure sensors deliver from said filling elements in conformity with their corresponding process steps;

(L) said controller is configured to determine, under consideration of data specific to filling material and/or container, as well as under consideration of parameters stored in said storage arrangement, in beverage and container dependent manner, a set point pressure behavior and said controller is configured to initiate, based on the corresponding comparison, between a set point pressure behavior and an actual pressure behavior, a signal for correcting the filling process, or to generate an error message;

(M) said at least one pressure sensor of each filling element is disposed at a gas channel formed in said filling element, said gas channel being in communication with the interior space of a corresponding container positioned at a corresponding filling element;

(N) said gas channel in which a corresponding pressure sensor is disposed, comprises that return gas channel that is connected with a corresponding return gas conduit of a corresponding filling element;

(O) said controller comprises computing apparatus operating under instructions of digital data processing; and (P) each pressure sensor produces an electrical signal representative of a sensed pressure, and said controller comprises an electronic control system which is common to all filling elements.

21. The filling machine in accordance with claim 5, wherein:

said controller is common to all filling elements;

each pressure sensor produces an electrical signal representative of a sensed pressure, and said controller comprises an electronic control system which is common to all filling elements; and said filling machine further comprising apparatus to pass a corresponding electrical signal representative of a sensed pressure to said common electronic control system.

22. A method of filling containers, said container comprising bottles or cans, with a liquid filling material, in a beverage container filling machine including a plurality of filling positions, each filling position comprising a filling element, said method comprising the steps of:

(a) positioning a container for filling with its mouth in sealing attitude at said filling element;

(b) introducing at least one process pressure into said container at each filling element;

(c) sensing at least one pressure indication representative of an at least one process pressure condition, during filling of a corresponding container with liquid, related to the interior space of a corresponding container with a sensor at each filling element;

(d) passing said at least one pressure indication representative of an at least one process pressure condition sensed, during filling of a corresponding container with liquid, related to the interior space of a corresponding container to a controller;

(e) controlling said at least one process pressure condition with said controller; and (f) filling a corresponding container with liquid.

23. The method according to claim 22 wherein a pressure behavior with respect to time during the filling process is individually sensed and passed from said sensor at each filling element to said controller, and further comprising the step of:

(f) comparing, with said controller, a corresponding actual pressure behavior with a pre-set pressure behavior or, respectively, a prevailing actual pressure with that associated set point pressure that results from a set point pressure behavior, and which is deposited in a storage arrangement of said controller in a manner which is specific to the filling material;

(g) initiating, with said controller, in an event of a difference, between an actual pressure and a set point pressure which exceeds a first tolerance limit, at least one error signal which comprises at least one identification of the corresponding filling element; and (h) initiating, with said controller, in an event of a difference, between an actual value and a set point value, which exceeds a pre-set second tolerance limit, at least one error message that comprises the identification of the corresponding filling element and that causes shutting-off of the filling machine and/or removal of the corresponding container that is present at the corresponding filling element.

24. The method according to claim 23 and further comprising the step of:

(i) producing, with said controller, in the presence of a difference, between a set point value and an actual value that is measured at the corresponding filling element, at least one signal in conformity with the difference, for correcting the corresponding process step, including for correcting the time of duration of the process step.

25. The method according to claim 24 and further comprising the step of:

(j) storing a pre-set value, as well as the associated tolerance limits in a storage arrangement of said controller, respectively specific for varying filling material types and specific for at least one process step.

26. The method according to claim 25 wherein in step (j), for filling methods with a plurality of method steps, the entire desired pressure behavior as to time is stored as actual value in said storage arrangement of said controller and including together with associated tolerance limits.

27. The method according to claim 26 and further comprising the step of:

(k) formulating, with said controller, a corresponding pre-set value or, respectively, a corresponding set point pressure behavior, during each new filling portion, thereby that said controller computes, from the signals delivered by said pressure sensors, a pressure behavior characteristic curve (steady state characteristic), through averaging of those pressure signals that are initiated by the various filling elements in corresponding filling method steps.

28. The method according to claim 27 and further comprising the step of:

(l) determining, with said controller, under consideration of preselected or input data representative of filling material and/or container, as well as under consideration of in said storage arrangement of said controller deposited liquid and container dependent parameters, a set point pressure behavior; and/or with said controller compute and produce, from the comparison, between set point pressure behavior and an actual pressure behavior, at least one signal to correct the filling process or an error signal.

29. The method according to claim 28 which comprises the step of:

(m) measuring a correspondingly prevailing pressure in a gas channel that is formed in a corresponding filling element which gas channel is in communication with the interior space of the corresponding container that is positioned at a corresponding filling element.

30. The method according to claim 22 which comprises at least one of (a) through (m):

(a) positioning a container for filling with its mouth in sealing attitude at said filling element;

(b) introducing at least one process pressure into said container at each filling element;

(c) sensing at least one pressure indication representative of an at least one process pressure condition related to the interior space of a corresponding container with a sensor at each filling element;

(d) passing said at least one pressure indication representative of an at least one process pressure condition related to the interior space of a corresponding container to a controller;

(e) controlling said at least one process pressure condition at least under adjustment of time with said controller;

(f) comparing, with said controller, a corresponding actual pressure behavior with a pre-set pressure behavior or, respectively, a prevailing actual pressure with that associated set point pressure that results from a set point pressure behavior, and which is deposited in a storage arrangement of said controller in a manner which is specific to the filling material;

(g) initiating, with said controller, in an event of a difference, between an actual pressure and a set point pressure, which exceeds a first tolerance limit, at least one error signal which comprises at least one identification of the corresponding filling element;

(h) initiating, with said controller, in an event of a difference, between an actual value and a set point value, which exceeds a pre-set second tolerance limit, at least one error message that comprises the identification of the corresponding filling element and that causes shutting-off of the filling machine and/or removal of the corresponding container that is present at the corresponding filling element;

(i) producing, with said controller, in a presence of a difference, between a set point value and an actual value that is measured at the corresponding filling element, au least one signal in conformity with the difference, for correcting the corresponding process step, including for correcting the time of duration of the process step;

(j) storing a pre-set value, as well as the associated tolerance limits in a storage arrangement of said controller, respectively specific for varying filling material types and specific for at least one process step; wherein in step (j), for filling methods with a plurality of method steps, the entire desired pressure behavior as to time is stored as actual value in said storage arrangement of said controller and including together with associated tolerance limits;

(k) formulating, with said controller, a corresponding pre-set value or, respectively, a corresponding set point pressure behavior, during each new filling portion, thereby that said controller computes, from the signals delivered by said pressure sensors, a pressure behavior characteristic curve (steady state characteristic), through averaging of those pressure signals that are initiated by the various filling elements in corresponding filling method steps;

(l) determining, with said controller, under consideration of preselected or input data representative of filling material and/or container, as well as under consideration in said storage arrangement of said controller deposited liquid and container dependent parameters, a set point pressure behavior; and/or with said controller compute and produce, from the comparison, between set point pressure behavior and an actual pressure behavior, at least one signal to correct the filling process or an error signal; and (m) measuring a correspondingly prevailing pressure in a gas channel that is formed in a corresponding filling element which gas channel is in communication with the interior space of the corresponding container that is positioned at a corresponding filling element.

31. The method according to claim 22 with comprises in combination (a) through (m):

(a) positioning a container for filling with its mouth in sealing attitude at said filling element;

(b) introducing at least one process pressure into said container at each filling element;

(c) sensing at least one pressure indication representative of an at least one process pressure condition related to the interior space of a corresponding container with a sensor at each filling element;

(d) passing said at least one pressure indication representative of an at least one process pressure condition related to the interior space of a corresponding container to a controller;

(e) controlling said at least one process pressure condition at least under adjustment of time with said controller;

(f) comparing, with said controller, a corresponding actual pressure behavior with a pre-set pressure behavior or, respectively, a prevailing actual pressure with that associated set point pressure that results from a set point pressure behavior, and which is deposited in a storage arrangement of said controller in a manner which is specific to the filling material;

(g) initiating, with said controller, in an event of a difference, between an actual pressure and a set point pressure, which exceeds a first tolerance limit, at least one error signal which comprises at least one identification of the corresponding filling element;

(h) initiating, with said controller, in an event of a difference, between an actual value and a set point value, which exceeds a pre-set second tolerance limit, at least one error message that comprises the identification of the corresponding filling element and that causes shutting-off of the filling machine and/or removal of the corresponding container that is present at the corresponding filling element;

(i) producing, with said controller, in a presence of a difference, between a set point value and an actual value that is measured at the corresponding filling element, at least one signal in conformity with a difference, for correcting the corresponding process step, including for correcting the time of duration of the process step;

(j) storing a pre-set value, as well as the associated tolerance limits in a storage arrangement of said controller, respectively specific for varying filling material types and specific for at least one process step; wherein in step (j), for filling methods with a plurality of method steps, the entire desired pressure behavior as to time is stored as actual value in said storage arrangement of said controller and including together with associated tolerance limits;

(k) formulating, with said controller, a corresponding pre-set value or, respectively, a corresponding set point pressure behavior, during each new filling portion, thereby that said controller computes, from the signals delivered by said pressure sensors, a pressure behavior characteristic curve (steady state characteristic), through averaging of those pressure signals that are initiated by the various filling elements in corresponding filling method steps;

(l) determining, with said controller, under consideration of preselected or input data representative of filling material and/or container, as well as under consideration of in said storage arrangement of said controller deposited liquid and container dependent parameters, a set point pressure behavior; and/or with said controller compute and produce, from the comparison, between set point pressure behavior and an actual pressure behavior, at least one signal to correct the filling process or an error signal; and (m) measuring a correspondingly prevailing pressure in a gas channel that is formed in a corresponding filling element which gas channel is in communication with the interior space of the corresponding container that is positioned at a corresponding filling element.

32. The method in accordance with claim 21, wherein:

said controller is common to all filling elements;

each pressure sensor produces an electrical signal representative of a sensed pressure, and said controller comprises an electronic control system which is common to all filling elements; and said filling machine further comprising apparatus to pass a corresponding electrical signal representative of a sensed pressure to said common electronic control system.

* * * * *

UNITED STATES PATENT AND TRADEMARK OFFICE

CERTIFICATE OF CORRECTION

PATENT NO. : 6,474,368 B2
DATED : November 5, 2002
INVENTOR(S) : Ludwig Clüsserath and Manfred Hartel It is certified that error appears in the above-identified patent and that said Letters Patent is hereby corrected as shown below:

Column 8,
Line 57, after "time", delete "to" and insert -- t6 --.

Column 17,
Line 54, after "the", delete "INNOCLE" and insert -- INNOCLEAN --.

Column 36,
Line 21, before "element" delete "filing" and insert -- filling --.

Column 39,
Line 61, after "element," delete "au" and insert -- at --.

Column 42,
Line 15, after "claim" delete "21," and insert -- 22, --.

Signed and Sealed this

Seventeenth Day of June, 2003

JAMES E. ROGAN
*Director of the United States Patent and Trademark Office*